US008215068B2

(12) United States Patent
Bongiorno

(10) Patent No.: US 8,215,068 B2
(45) Date of Patent: Jul. 10, 2012

(54) METHOD AND APPARATUS FOR INCREASING THE ENERGY DISSIPATION OF STRUCTURAL ELEMENTS

(76) Inventor: Steven James Bongiorno, Freeport, NY (US)

( * ) Notice: Subject to any disclaimer, the term of this patent is extended or adjusted under 35 U.S.C. 154(b) by 249 days.

(21) Appl. No.: 12/606,240

(22) Filed: Oct. 27, 2009

(65) Prior Publication Data

US 2010/0101160 A1 Apr. 29, 2010

Related U.S. Application Data

(60) Provisional application No. 61/108,566, filed on Oct. 27, 2008.

(51) Int. Cl.
*E04B 1/98* (2006.01)
*E04H 9/02* (2006.01)

(52) U.S. Cl. ..... 52/167.8; 52/167.6; 52/223.6; 52/223.8; 52/223.14

(58) Field of Classification Search ..... 52/167.1, 52/167.6, 167.8, 167.4, 745.05, 745.21, 223.6, 52/223.1, 223.8, 223.4, 223.14; 405/286, 405/285, 302.2, 275
See application file for complete search history.

(56) References Cited

U.S. PATENT DOCUMENTS 2,786,349 A * 3/1957 Coff ..... 52/223.4
3,513,609 A * 5/1970 Lang ..... 52/223.6
3,835,607 A * 9/1974 Raaber ..... 52/223.8
3,867,804 A * 2/1975 Wilson ..... 52/699
3,913,707 A * 10/1975 Wastenson et al. ..... 188/374
4,417,427 A 11/1983 Bschorr
4,511,115 A * 4/1985 Ludwigsen ..... 248/562
4,565,039 A * 1/1986 Oguro et al. ..... 52/167.4
4,630,412 A * 12/1986 Engstrom et al. ..... 52/1
4,805,359 A * 2/1989 Miyake et al. ..... 52/167.6
5,459,973 A * 10/1995 Baumann ..... 52/848
6,070,850 A * 6/2000 Lehman ..... 248/622
6,135,501 A * 10/2000 Rinehart ..... 280/838
6,530,182 B2 * 3/2003 Fanucci et al. ..... 52/167.3
7,174,680 B2 * 2/2007 Smelser ..... 52/167.3
7,337,586 B2 * 3/2008 Lin et al. ..... 52/167.1

OTHER PUBLICATIONS

Kareem, et al, "Mitigation of Motions of Tall Buildings with Specific Examples of Recent Applications", 1999, pp. 211-239.
Jose Restrepo, "New Generation of Structural Concrete Systems for Seismic Resistance", First European Conference on Earthquake Engineering and Seismology, Geneva, Switzerland, Sep. 2006.
Symas, et al., "Energy Dissipation Systems for Seismic Applications: Current Practice and Recent Developments", Jan. 2008, Journal of Structural Engineering © ASCE , pp. 6-10.

* cited by examiner

*Primary Examiner* — William Gilbert
*Assistant Examiner* — Chi Q Nguyen
(74) *Attorney, Agent, or Firm* — Alfred M. Walker

(57) ABSTRACT

According to one embodiment, the energy dissipation of a structural element is increased by inserting one or more resisting elements into the structural element at any time during or after construction of the structural element. The continuous resisting elements are rigidly attached to the structural at one end and connected to the structural element by and through a damping material over at least a portion of its length. When a dynamic force is applied to the structural elements, such as may result from wind or earthquakes, there will be a strain in the structure, in a direction parallel with the longitudinal direction of the resisting elements. In this way, the forces and deformations within the structure will result in a relative motion between the structural element and resisting element, a substantial portion of which is ultimately transmitted by and through the damping material layer. In transmitting such a force and movement through the damping material layer, a portion of the energy associated with such force and movement is dissipated.

6 Claims, 26 Drawing Sheets

METHOD AND APPARATUS FOR INCREASING THE ENERGY DISSIPATION OF STRUCTURAL ELEMENTS

CROSS-REFERENCE TO RELATED APPLICATIONS

This application claims the benefit of provisional patent application Ser. No. 61/108,566, filed Oct. 27, 2008 by the present inventor.

BACKGROUND

1. Field

This application relates generally to a method of, and a system for, modifying the dynamic response of structures, and more particularly, to a method of, and a system for, increasing the energy dissipation capacity of structures.

2. Related Art

Most structures are subjected to dynamic excitation, or vibration, at some time. These vibrations may arise from wind, earthquake excitation, blast, machinery, or many other sources. The resulting vibrations may interact with the structure to induce inertial forces, which may result in a significant increase in structural loading. In some cases, especially under strong earthquake excitations, such vibrations may cause significant structural damage, or even collapse. In many cases vibrations may also affect the serviceability of a structure or the comfort of its occupants.

The dynamic response of a structure to such vibrations governed by several factors, among which, is the degree of energy dissipation that a structure can provide. This energy dissipation capability is often referred to as damping.

There are two principal sources of damping in conventional structures. The first is the so-called inherent, or intrinsic, damping from the materials comprising all of the elements of the structure. The second principle source of damping in structures comes from supplemental systems and devices, which modify the dynamic properties of the elements, or sometimes function as independent sub-systems within the structure.

It is often desirable, and sometimes necessary, to increase the energy dissipation capabilities of a structure, or individual elements of a structure. Others have proposed such means of providing supplemental damping for structures. Those skilled in the art will be familiar with the numerous so-called supplemental damping systems and devices currently in use. A description of some such systems and devices can be referenced from "Mitigation of Motions of Tall Buildings with Specific Examples of Recent Applications", by Kareem, et. al. 1999 as well as from "Energy Dissipation Systems for Seismic Applications: Current Practice and Recent Developments", by Symans, et. al. 2008. Reference is also made to the prior art described in "New Generation of Structural Concrete Systems for Seismic Resistance", by Restrepo, 2006. The method and apparatus of prior art U.S. Pat. No. 4,417,427 issued to Bschorr Nov. 29, 1983 also attempts to achieve an increase in the energy dissipation capability, or damping, for concrete structural elements. All such prior art systems posses certain disadvantages:

(a) Where an energy dissipating means comprises an element that requires a space allocation beyond the extent of the structural elements, such space allocation may limit the architectural layout and function of the structure, and may require a sacrifice of valuable architecture. Further, such an intrusion may limit the architectural flexibility of the structure for future amended use.

(b) Where an energy dissipating means comprises an apparatus that is constructed within a structural element in such a way that the energy dissipating means is immediately engaged in its force-transmitting and energy dissipating function with the completed structural element, premature, unexpected or undesirable stress and strain in may occur in the energy dissipating means. Such residual stress and strain may result in permanent damage to the energy dissipating means, or otherwise render the damping means ineffective or inefficient for its intended purpose.

(c) Where an energy dissipating means comprises an apparatus that is constructed within a structural element in such a way that does not permit its removal and replacement at any time, there may be no way to modify or inspect the energy dissipating means after its installation. Similarly, where there is no way to install the energy dissipating means within a structural element, after construction of the structural element, it may not be possible to monitor the completed structure to determine the specific design requirements of the energy dissipating means, or weather such energy dissipating means is required at all.

(d) Where an energy dissipating means comprises an apparatus with an energy dissipation material means that is installed in-situ at a construction site, adequate quality assurance measures may not be possible.

Accordingly, it would be desirable to have an effective, reliable and controllable method and apparatus for increasing the energy dissipation of structures that overcomes the disadvantages associated with the prior art.

It is further desirable to provide an energy dissipating means that is internal to the structural element for which the energy dissipation is provided. Those skilled in the art will recognize the benefit of providing a non-obtrusive means that does not encroach, or otherwise interfere, with the use, or architectural flexibility, of the structure.

It is further desirable to permit the energy dissipating means to be installed, yet remain decoupled from the structure in its force resisting and energy dissipating function, until such time that it is desired to make it effective.

It is further desirable to permit the installation, removal, inspection, repair or replacement of the energy dissipating means to be made at any time during the life of the structure. Those skilled in the art will appreciate that in many situations, especially for earthquake design, it may be desirable, or even mandated, to be able to inspect, repair, or replace all or some portion of a supplemental energy dissipating means after a major earthquake. Similarly, it is desirable to permit the specific design requirements, or even necessity, of an energy dissipation means to be assessed during, or after, completion of the structure, and then implemented to address such requirements. Additionally, if there is a future change in the design requirements, such as by code mandate, or by design intent, it is desirable to have the capability to remove the original energy dissipation means and replace it with a new or modified energy dissipation means, having been so designed and modified to address any such new requirements.

It is further desirable to permit the application of any energy dissipation material means to be made under controlled conditions, and protected from exposure to damage during installation of the energy dissipation means into the structure

SUMMARY

In accordance with one embodiment, the energy dissipation capacity, or damping, of a structural element is increased by installing one or more resisting elements within the structural element. Each resisting element is provided with a damping means, over at least a portion of its length. This portion is the damped constrained length portion of the resisting element, and is further provided with a connection means to the structural element. The connection means is provided so as to ensure that the connection of the structural element to the resisting element occurs by and through the damping means, so that all forces transmitted between the resisting element and the structural element occurs by and through the damping means. The damping means is further provided in such a way as to both facilitate relative movement between the resisting element and the structural element and to dissipate the energy causing such movement. The remaining portion of the resisting element is the un-damped free length portion, and the extreme end of this portion is provided with an anchorage means to the structural element.

The resisting element may be installed during construction of the structural element, or anytime thereafter, at which time the end of the un-damped free length portion is attached in a rigid force-transmitting manner directly to the structural element by way of an anchorage means. The remaining length of the resisting element is left free to move relative to the structural element, until such time as it is desired to engage the resisting element in its force-transmitting and energy dissipating functions. At that time, the damped constrained length portion of the resisting element is connected to the structural element by way of the connection means described above. If at any later time it is desired to disengage the resisting element in its force transmitting and damping functions, the connection means may be disconnected. If it is also desired to remove the resisting element from the structural element, the anchorage means may be disconnected as well.

Thus, the resisting element provides energy dissipation to the structural element by having a damping means capable of dissipating a portion of the energy associated with the relative movement between the structural element and the resisting element in the constrained length portion. Such relative movement results from the compatibility of deformations in the structural element between the points within the damped constrained length portion and the point of anchorage of the un-damped free length portion.

DRAWINGS

Figures

FIG. 1A a perspective view of the principle arrangement of the embodiments for a representative structural element shape FIG. 1B a perspective view of the principle arrangement of the embodiments for another representative structural element shape.

REFERENCED NUMERALS

Figure 1A:
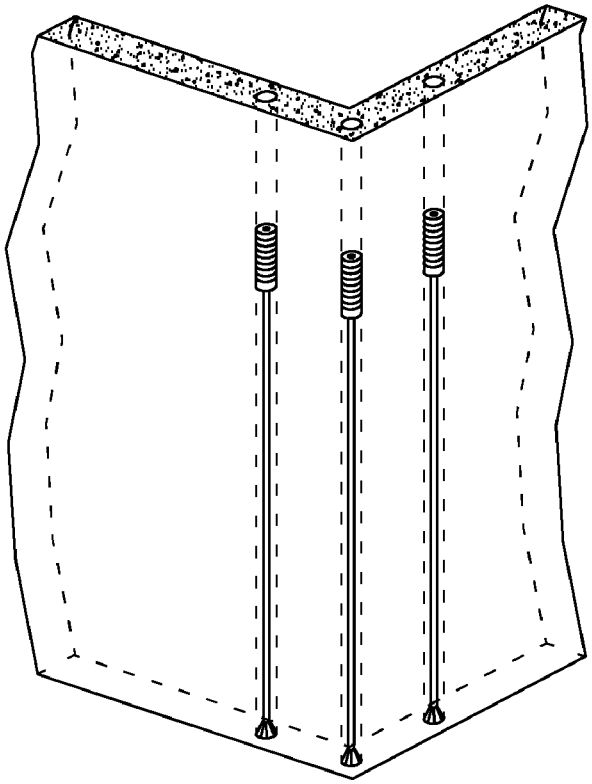
FIG. 1C is a perspective view of the principle arrangement of the embodiments for yet another representative structural element shape.

1—Structural Element
2—Resisting Element Means
3—Damping Means
4—Structural Anchorage Means
5—Hollow Casing Means
9—Installation and Removal Means
12—Installation and Removal Extension Element
13—Protective Cap
22A—Resisting Element—Damped Constrained Length Portion
22B—Resisting Element—Un-Damped Free Length Portion
24—Threads
26A—Resisting Element Coupling Device
26B—Coupling Device
26C—Friction Coupling Device
28—Damping Material
30A—Resisting Element Deformations
30B—Resisting Element Casing Deformations
30C—Transfer Casing Deformations
32—Compressible Gasket
34—Diaphragm Plate
36—Grout
38—Resisting Element Casing
40—Grout Inlet Port Hole
42—Grout Outlet Port Hole
44—Internal Threads
46—Resisting Element Casing Transfer Block
47—Resisting Element Casing Connector Block
48—Internally Threaded Hole
50—Transfer Bolt
52A—Resisting Element Casing Guide Plate
52B—Transfer Casing Guide Plate
54—Bar Centralizer
56—Set Screw
58—Internally Threaded Bore
60—Anchoring Element
62—Anchoring Element Coupling Device
68—Transfer Casing
70—Transfer Casing Transfer Block
72A—Slotted Hole in Transfer Casing
72B—Slotted Hole in Transfer Casing Transfer Block
74A—Transfer Casing Transfer Block Serrations
74B—Plate Washer Serrations
76—Plug Weld
78—Weld Access Hole
80—Plate Washer
82—Guide Collar
84A—Compressible Ring (First Embodiment)
84B—Compressible Ring (Third Embodiment)
86—Ring Flanges
88A—Alignment Plates on Guide Collar
88B—Alignment Plates on Transfer Casing
90—Alignment Plate Hole
92A—Transfer Casing Transfer Block Access Hole
92B—Fixed-End Access Hole
92C—Grout Sleeve Access Hole
94—Lifting Device
96—Casing Suspension Bracket
98—Casing Suspension Bolt
100—Suspension Bolt Hole
104—Duct
105—Non-Communicating Sleeve
106—Bulkhead plate
108—Corrugations
110—Grout Inlet Sleeve
112—Grout outlet Sleeve
114—Grout Tube
116—Compressible Filler Material
118—Cap Plate
120—Duct Coupling Sleeve
122—Friction Connector
123—Serrated Rail
124—Friction Connector and Coupling Guide Plate
125—Friction Screws
126—Extraction Screws

DETAILED DESCRIPTION

The subject of this application will now be described in detail, with reference to the accompanying drawings shown in FIGS. 1-30, as well as the referenced numerals shown in those figures. Where similar components are shown in multiple figures, the respective reference numerals may be not be repeated.

Figure 1B:
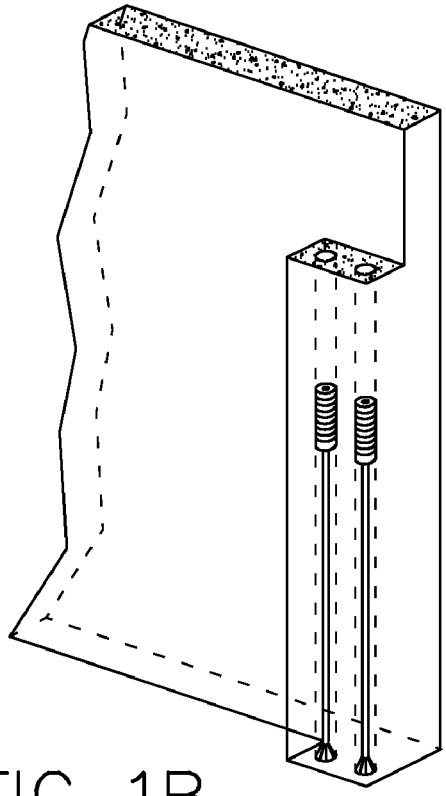
Figure 1C:
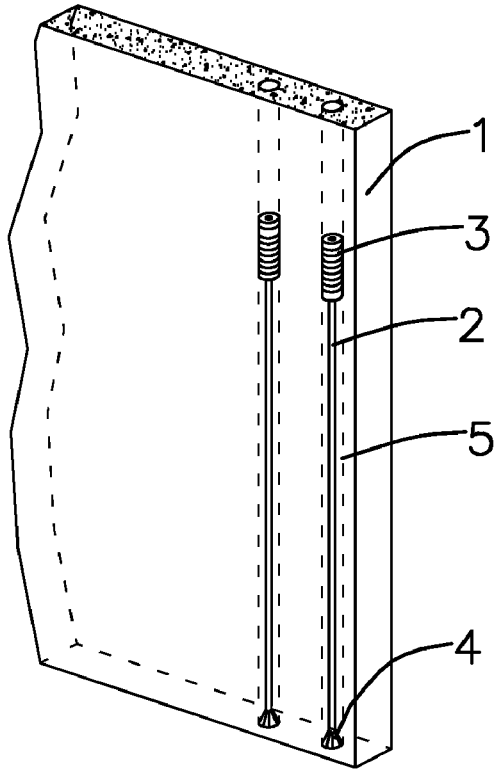
Figure 2A:
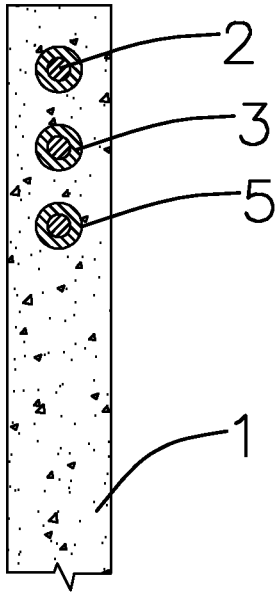
FIG. 2A is a sectional plan view of the principle arrangement of the embodiments for a representative structural element shape.
Figure 2B:
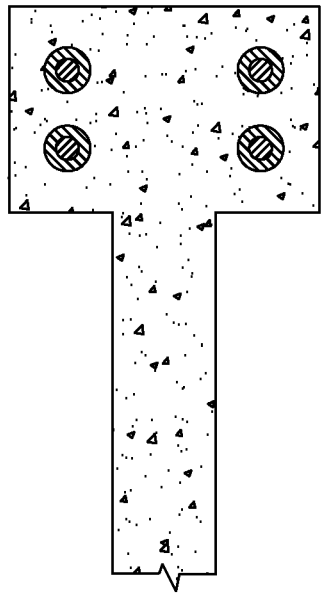
FIG. 2B is a sectional plan view of the principle arrangement of the embodiments for another representative structural element shape.
Figure 2C:
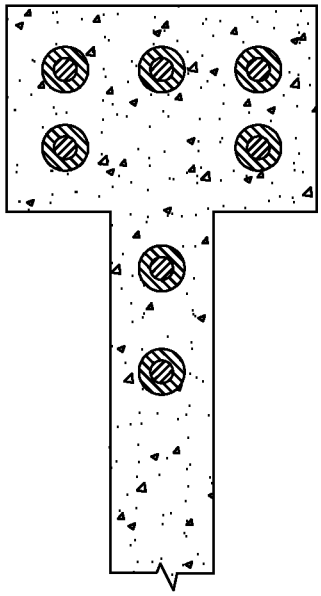
FIG. 2C is a sectional plan view of the principle arrangement of the embodiments for yet another representative structural element shape.
Figure 2D:
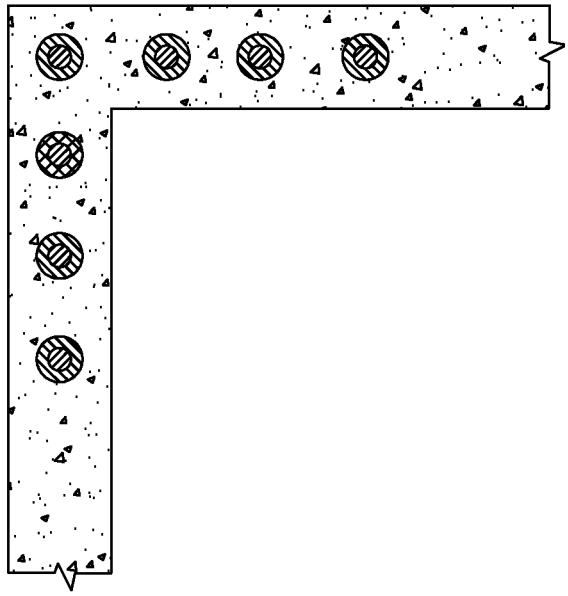
FIG. 2D is a sectional plan view of the principle arrangement of the embodiments for yet another representative structural element shape.
Figure 3:
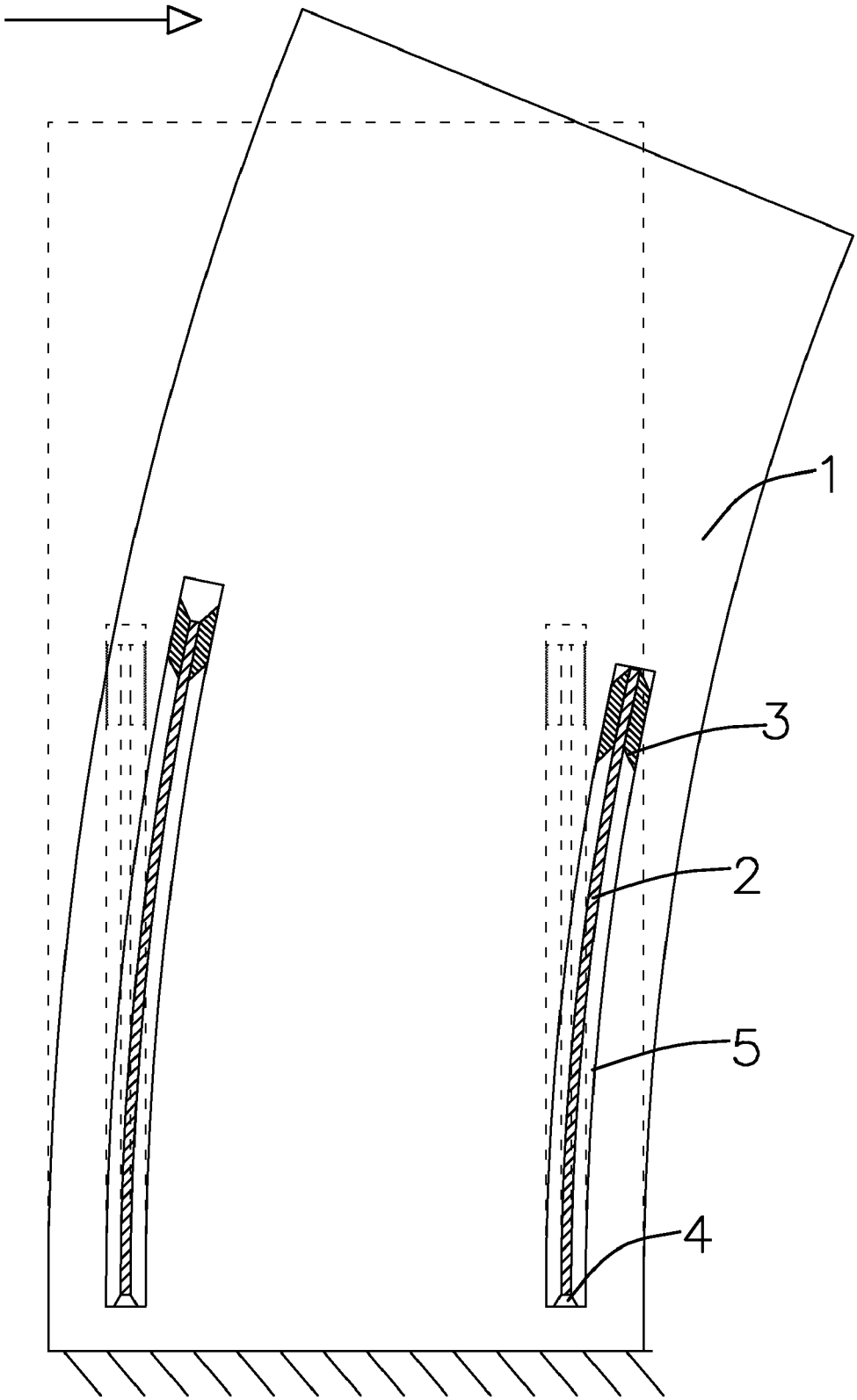
FIG. 3 is an elevational sectional view of the principle arrangement of the embodiments illustrating a generic displaced shape profile of the structural element.

FIGS. 1-3 illustrate the principle arrangement of the embodiments, wherein a structural element (1), such as a column or wall of a concrete structure is constructed with one or more hollow casing means (5), which are constructed integrally within the structural element (1). The hollow casing means (5) are further constructed in a force-transmitting manner with the structural element (1). A complimentary number of resisting element means (2) are each provided with a damping means (3) over at least a portion of their length. This portion will be referred to as the damped constrained length portion of the resisting element means (2). The remaining portion of the resisting element means (2) will be referred to as the un-damped free length portion. The hollow casing means (5) and the resisting element means (2) are further provided with a means of connecting the two in a force-transmitting manner within the damped constrained length portion, whereby the force-transmission occurs by and through the damping means (3).

At any time during or after construction of the structural element (1) and the hollow casing means (5), the resisting element means (2) may be installed into the structural element (1) by way of the hollow casing means (5). The resisting element means (2) is then rigidly attached, or anchored to, the structural element (1) by a structural anchorage means (4) at one extreme end of the resisting element means (2), preferably the lower extreme end for a vertically oriented resisting element means (2). The remaining portions of the resisting element means (2) are left free to move longitudinally with respect to the hollow casing means (5). When it is desired to engage the resisting element means (2) in its force-transmitting and damping functions with the structural element (1), the above-mentioned connection between the hollow casing means (5) and the resisting element means (2) is executed. If at any later time it is desired to remove the element means (2), or otherwise disengage the resisting element means (2) in its force transmitting and damping functions, the connection may be undone.

Figure 4:
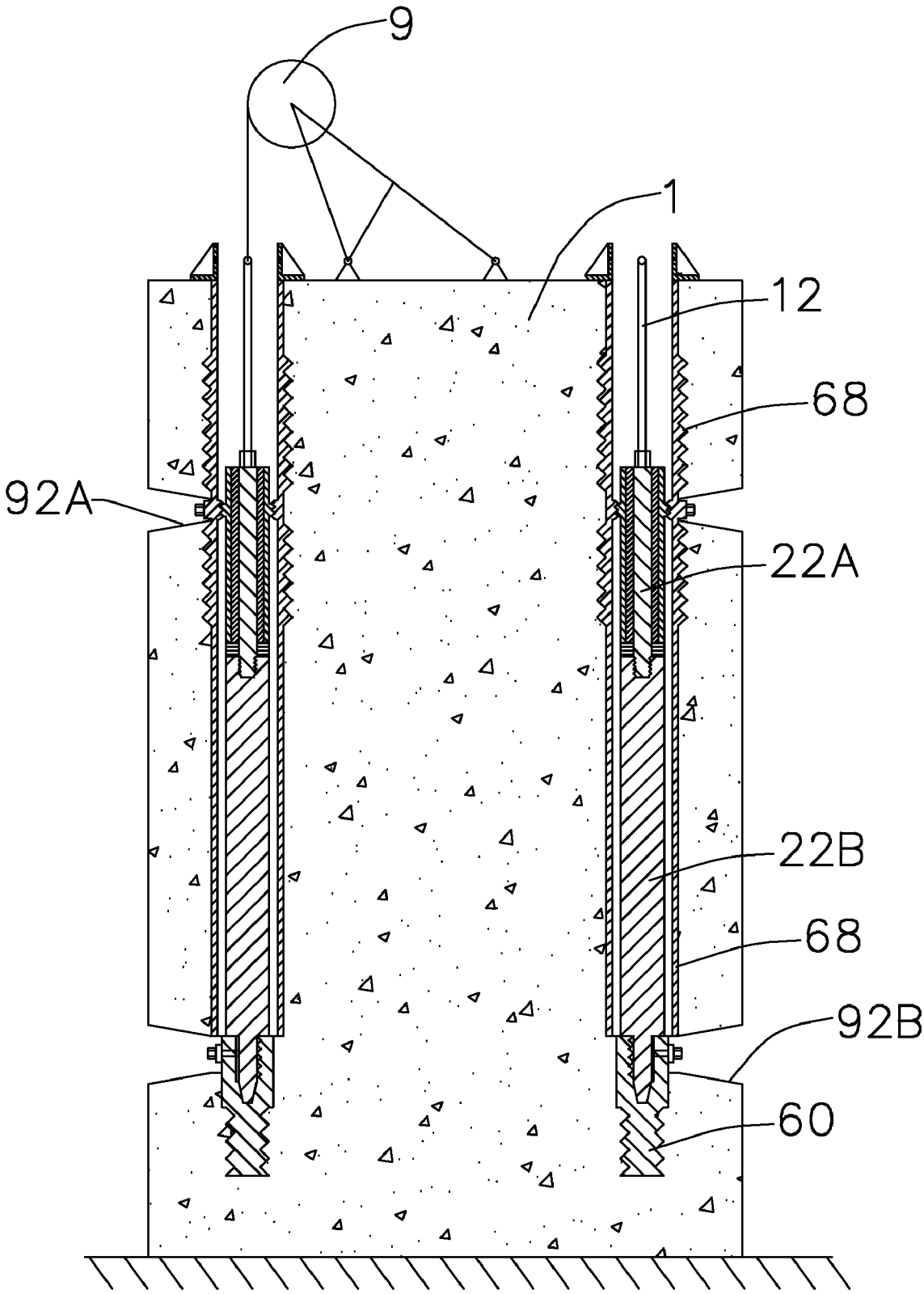
FIG. 4 is an elevational sectional view of the principle arrangement of the first embodiment.
Figure 5:
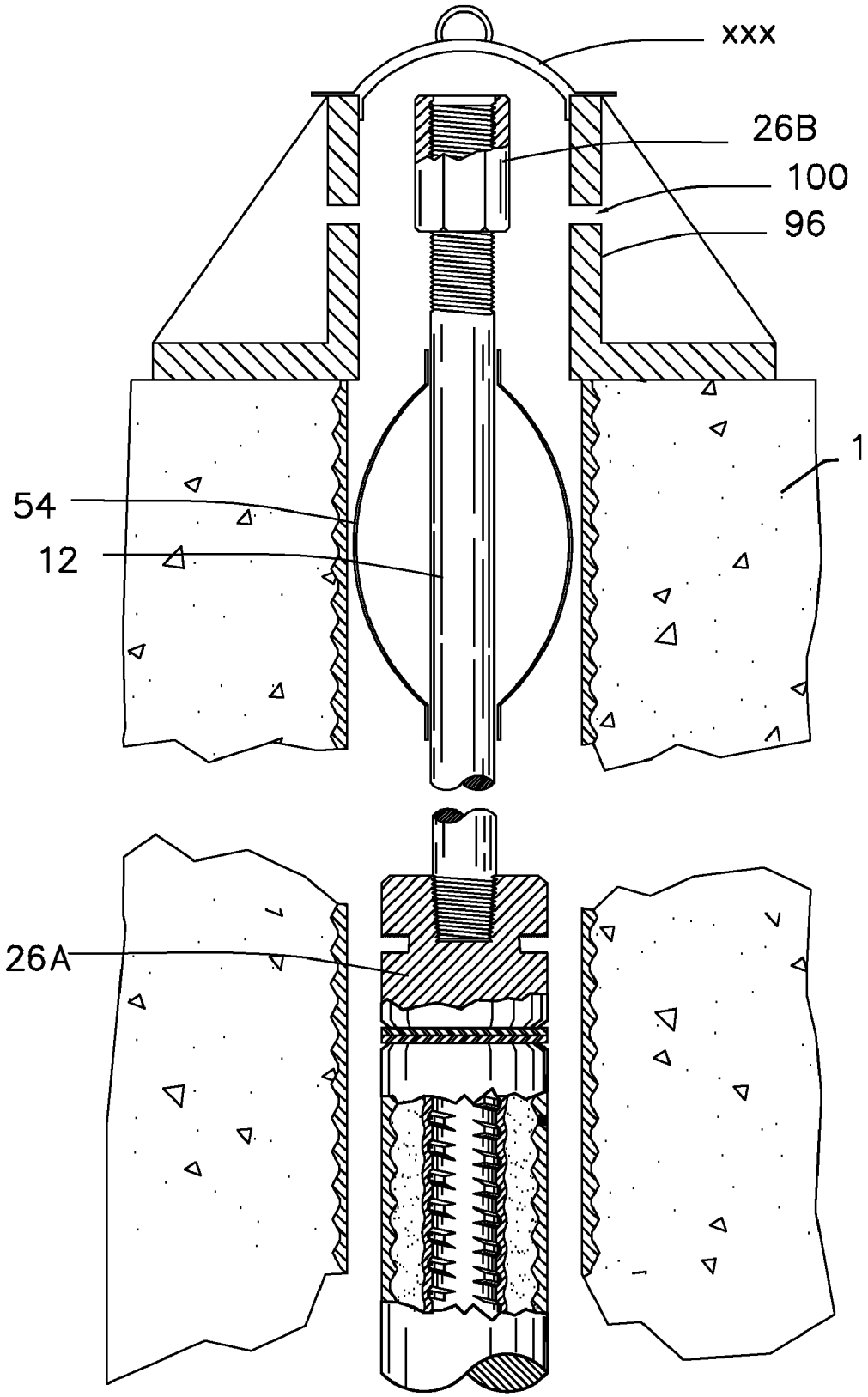
FIG. 5 is a longitudinal sectional view of the first embodiment located at the free end of the apparatus.
Figure 6:
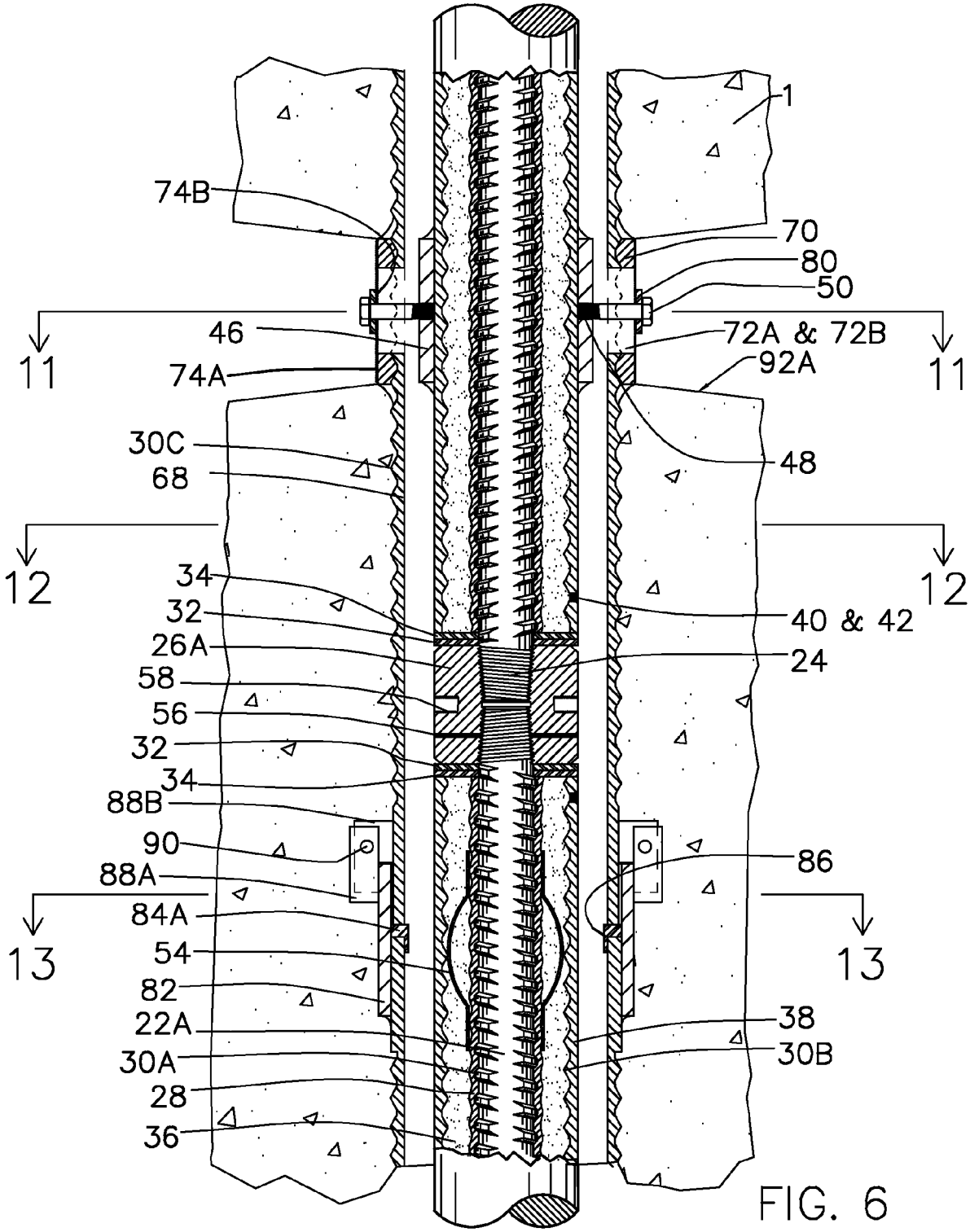
FIG. 6 is a longitudinal sectional view of the first embodiment located within the damped constrained length portion of the apparatus.

FIGS. 4-16 illustrate the first embodiment, where FIG. 4 depicts the general arrangement of the component means for reference to the detailed component descriptions now provided.

Referring now to FIGS. 5-8, as well as the sections figures referenced therein, within the damped constrained length portion of the embodiment, a resisting element (22A), preferably comprised of a steel bar with surface deformations (30A), is provided in segments, with lengths appropriate for fabrication, transportation and installation. The deformations (30A) should preferably be of sufficient size, orientation, depth and shape so as to provide adequate force transmission between the resisting element (22A) and the surrounding components. Each resisting element segment preferably has threads (24) provided on each end to accept a coupling device (26A), to be described later.

The resisting element (22A) segments are then enveloped, or otherwise wrapped or coated by a layer of damping material (28), preferably having viscoelastic damping properties and capable of exhibiting viscoelastic damping behavior.

A resisting element casing (38), comprised preferably of a steel cylindrical section having surface deformations (30B) on its interior surface, is provided in approximately the same lengths as the resisting element segments. The internal diameter of the resisting element casing (38) should preferably be of sufficient dimension so as to allow for the proper placement of grout (36) into the annular space between the resisting element casing (38) and the damping material (28). The internal diameter should preferably also allow for sufficient grout thickness to ensure the proper transmission of forces through the grout (36). The deformations (30B) should preferably be of sufficient size, orientation, depth and shape so as to provide adequate force transmission between the resisting element casing (38) and the grout (36). Such surface deformations (30B) may be achieved, among many possible ways, by forming the resisting element casing (38) from steel plate material having deformations rolled or pressed into it. Similar deformed steel plate materials are commercially available as so-called "diamond plate", or "checker plate", among others. The resisting element casing (38) should preferably be of sufficient strength and stiffness to withstand internal pressure from grouting, as well as to retain its shape and integrity during transportation and installation. The casing should preferably also be of sufficient strength and stiffness to distribute forces from any discrete attachment points with the structural element (1) uniformly to the damping material (28). Each segment of the resisting element casing (38) is preferably provided with grout inlet port holes (40) as well as complimentary grout outlet, or vent, port holes (42) to aid in the placement of grout (36). Both the grout inlet port holes (40) as well as grout outlet port holes (42) may be provided with internal threads (44).

Resisting element casing transfer blocks (46) symmetrically placed on both sides of the resisting element casing (38) are preferably comprised of a steel sections with internally threaded holes (48) to permit the installation of transfer bolts (50), as will be described later. The resisting element casing transfer blocks (46) are attached to the resisting element casing (38) preferably by welding. The size of the resisting element casing transfer blocks (46), the number of internally threaded holes (48), as well as the number and spacing of the resisting element casing transfer blocks (46) along the longitudinal length of the resisting element casing (38), is determined by design, based on the magnitude of the force to be transmitted between the structural element (1) and the resisting element (22A), among other things. The size and number of internally threaded holes (48) should preferably also be sufficient to support any temporary loading during installation and removal of the resisting element casing (38) into and out of the structural element (1)

Guide plates (52A), symmetrically placed on both sides of the resisting element casing (38) and orthogonal to the centerline of the internally threaded holes (48) in the resisting element casing transfer blocks (46), are preferably comprised of steel plate sections welded to the resisting element casing (38). The guide plates (52A) are preferably continuous and should preferably be located so as to allow for unimpeded movement with respect to the complementary guide plates (52B) on the transfer casing (68), to be described shortly. The guide plates (52A) should preferably also be located so as to minimize any lateral and rotational movement of the resisting element casing (38). The guide plates (52A) may be provided with a lubricating means to facilitate this movement.

The so prepared resisting element segments are further provided with bar centralizers (54), placed at sufficient intervals along the segment length so as to ensure straightness and constant dimensional relation to the so prepared resisting element casing (38) segments. The resisting element segments, so prepared, are placed into the thus prepared resisting element casing segments. Diaphragm plates (34), preferably comprised of circular steel plates with a central hole of the approximate size and shape of the resisting element (22A), are placed at each open end of the resisting element casing (38), where they are welded to the resisting element casing (38) and the resisting element (22A). The thus connected diaphragm plates (34) serve to connect the resisting element (22A) and the resisting element casing (38) so that any rotation, or twisting, of the resisting element casing (38), such as may be caused during installation, is transferred directly to the resisting element (22A) and not through or by the damping material (28) or grout (36). The diaphragm plates (34) may also serve as a closure plate, thus preventing grout from escaping during placement. The properties of the diaphragm plates (34) and their connections should be chosen so as to minimize the transmission of force between the resisting element casing (38) and the resisting element (22A) through the diaphragm plate (34) in a direction parallel with the longitudinal direction of the resisting element casing (38) and the resisting element (22A).

The thus prepared assembly is then filled, preferably with a cementations or resin based grout (36). The grout (36) may be injected into the annular space between the resisting element casing (38) and the damping material (28) by way of the inlet portholes (40) and outlet port, or vent, holes (42). The grout (36) is preferably injected under pressure, so as to ensure complete filling of the annular space between the resisting element casing (38) and the damping material (28). Suitable grouts, as well as the methods and equipment used for grouting, will be well known by those skilled in the art. Such materials, methods and equipment are used regularly in the post-tensioning industry. The properties of the grout (36) should preferably be compatible with the damping material (28), so as to minimize the potential of any adverse reaction between the grout (36) and the damping material (28). The grout (36) should preferably also have properties that allow it to maintain adequate confinement and force transfer capacity between the resisting element casing (38) and the damping material (28). Such properties may be achieved, among many ways, by using so-called "non-shrink" grout, or by providing grout containing expansive admixtures.

A compressible gasket (32) is installed on one end of each resisting element (22A) segment, where a coupling device (26A) will be placed. The compressible gasket (32) properties and thickness should preferably be sufficient to ensure that no forces are transmitted directly between successive resisting element casing segments, but rather by the resisting element (22A).

A coupling device (26A), preferably an internally threaded steel coupler, having internal threads (44) complimentary to those formed on the ends of the resisting elements, is installed on one end of each resisting element (22A) segment after the compressible gasket (32) has been placed, as described above. The coupling device (26A) is then secured to the resisting element (22A), preferably by installing set screws (56) through the coupling device (26A) and into the resisting element (22A). The properties and dimension of the coupling device (26A) should preferably be sufficient to transmit any anticipated forces between the resisting elements (22A) thus connected, as well as any forces associated with the installation and erection methods. The coupling device (26A) is further provided with internally threaded bores (58), placed symmetrically in pairs. The size and threading of the internally threaded bores (58) should preferably be compatible with casing suspension bolts (98), to be described later.

Still referring to FIGS. 5-8, as well as the sections figures referenced therein, a transfer casing (68), comprised preferably of a steel cylindrical section having surface deformations (30C) on its exterior peripheral surface is provided in segments with lengths appropriate for fabrication, transportation and installation, and preferably in some multiple of the resisting element casing (38) segment lengths. The deformations (30C) should preferably be of sufficient size, orientation, depth and shape so as to provide adequate force transmission between the structural element (1) and the transfer casing (68). Such surface deformations (30C) may be achieved in a manner similar to those of the resisting element casing (38). The transfer casing (68) should preferably be of sufficient strength and stiffness to withstand the external pressure of concrete placement, as well as to retain its shape and integrity during transportation and installation. The transfer casing (68) should preferably also be of sufficient strength and stiffness to distribute the somewhat uniform distribution of forces from the surrounding structural element (1) to the transfer casing transfer blocks (70), to be described later. Slotted holes (72A), with the slotted portion in a direction parallel with the longitudinal direction of the transfer casing (68), are provided with the same dimensions and at the same locations as the complimentary slotted holes (72B) provided in the transfer casing transfer blocks (70), to be described shortly.

The internal diameter of the transfer casing (68) should preferably be of sufficient dimension so as to allow for the proper installation of the resisting element casing (38) within it, as will be described later. Such dimension should preferably account for all fabrication and construction tolerances, among other things.

Transfer casing transfer blocks (70) symmetrically placed on both sides of the resisting element casing (38) are preferably comprised of a steel sections with slotted holes (72B), with the slotted portion in a direction parallel with the longitudinal direction of the transfer casing (68). The width of the slotted holes (72A and 72B) should preferably be sufficient to accommodate reasonable construction and fabrication tolerances for the installation of a transfer bolt (50), yet be capable of providing adequate restraint to ensure buckling stability of the installed resisting element casing (38). The length of the slotted holes (72A and 72B) should preferably be sufficient to accommodate all construction and fabrication tolerances. The Transfer casing transfer blocks (70) are attached to the transfer casing (68) preferably by welding. The outer face of the Transfer casing transfer blocks (70) preferably has serrations (74A), or toothed profiles as they are also known, formed into the surface.

The size of the transfer casing transfer blocks (70), the geometry and extent of the serrations (74A), the number of slotted holes (72A and 72B) as well as the number and spacing of the transfer casing transfer blocks (70) along the longitudinal direction of the transfer casing (68) is determined by design, based on the magnitude of the force to be transmitted between the structural element (1) and the resisting element (22), among other things. The number and location of the transfer casing transfer blocks (70) and the resisting element transfer blocks (46) is complimentary.

Guide plates (52B), symmetrically placed on both sides of the inside face of the transfer casing (68), complimentary to the guide plates (52A) on the resisting element casing (38), are similarly comprised preferably of steel plate sections welded to the transfer casing (68). These welds may be intermittent plug welds (76) made through intermittent weld access holes (78) from the exterior periphery of the transfer casing (68) during fabrication. The guide plates (52B) are preferably continuous and similarly should preferably be located so as to allow for unimpeded movement with respect to the complementary guide plates (52A) on the resisting element casing (38), while similarly minimizing the lateral and rotational movement of the resisting element casing (38). The guide plates (52B) may be similarly provided with a lubricating means to facilitate this movement.

Transfer bolts (50), are provided with threads that are complimentary to those of the internally threaded holes (48) provided in the resisting element casing transfer block (46). The transfer bolts (50) are provided with sufficient length to allow for proper installation and engagement into the resisting element casing transfer block (46). The properties and diameter of the transfer bolts (50) should preferably be sufficient to provide adequate force transmission between the transfer casing transfer block (70) and the resisting element casing transfer block (46).

The transfer bolts (50) are provided with plate washers (80), having serrations (74B) complimentary to the serrations (74A) on the transfer casing (68). The size of the plate washer (80), as well as the geometry and extent of the serrations (74A and 74B), is determined by design, based on the magnitude of the force to be transmitted between the structural element (1) and the resisting element (22), among other things.

Figure 7:
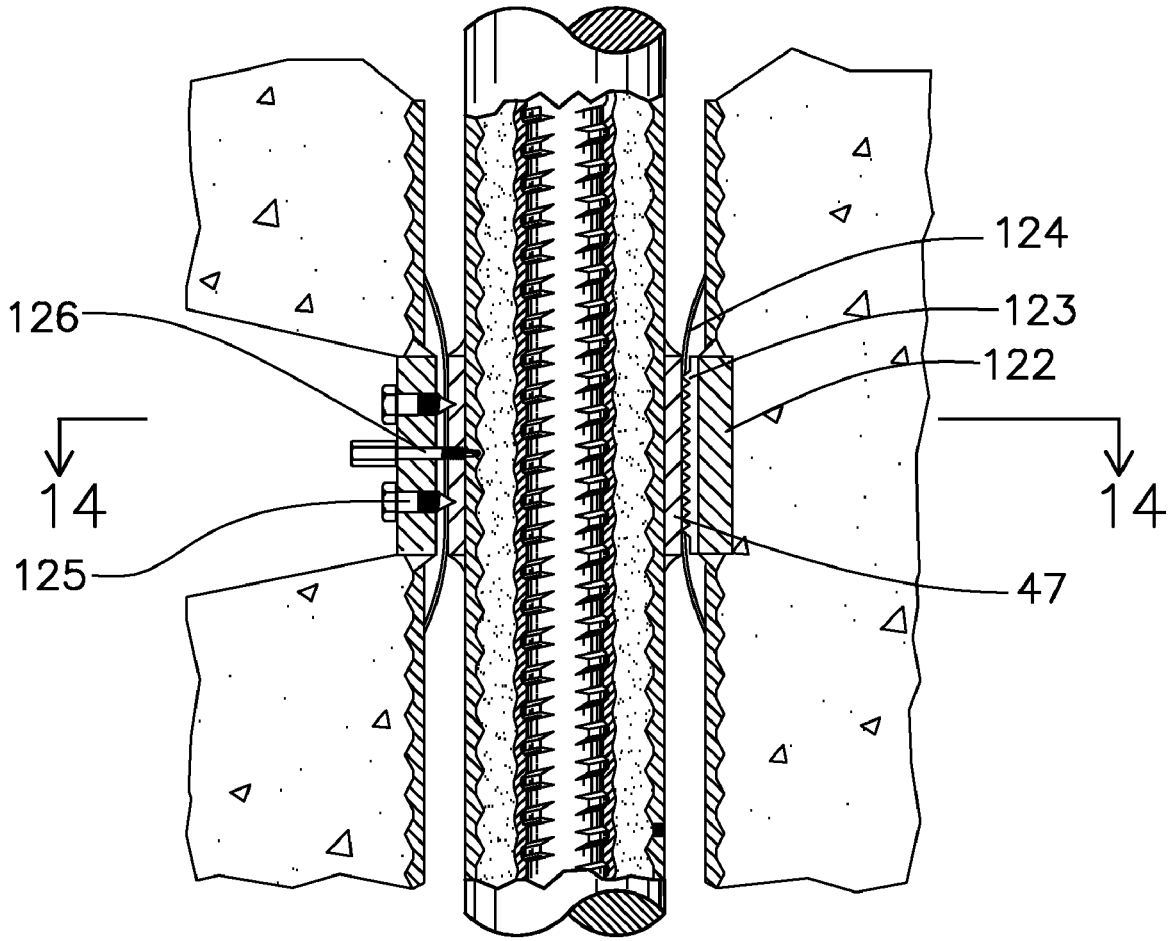
FIG. 7 is a longitudinal sectional view of an alternative structural connection means within damped constrained length portion of the apparatus.
Figure 14:
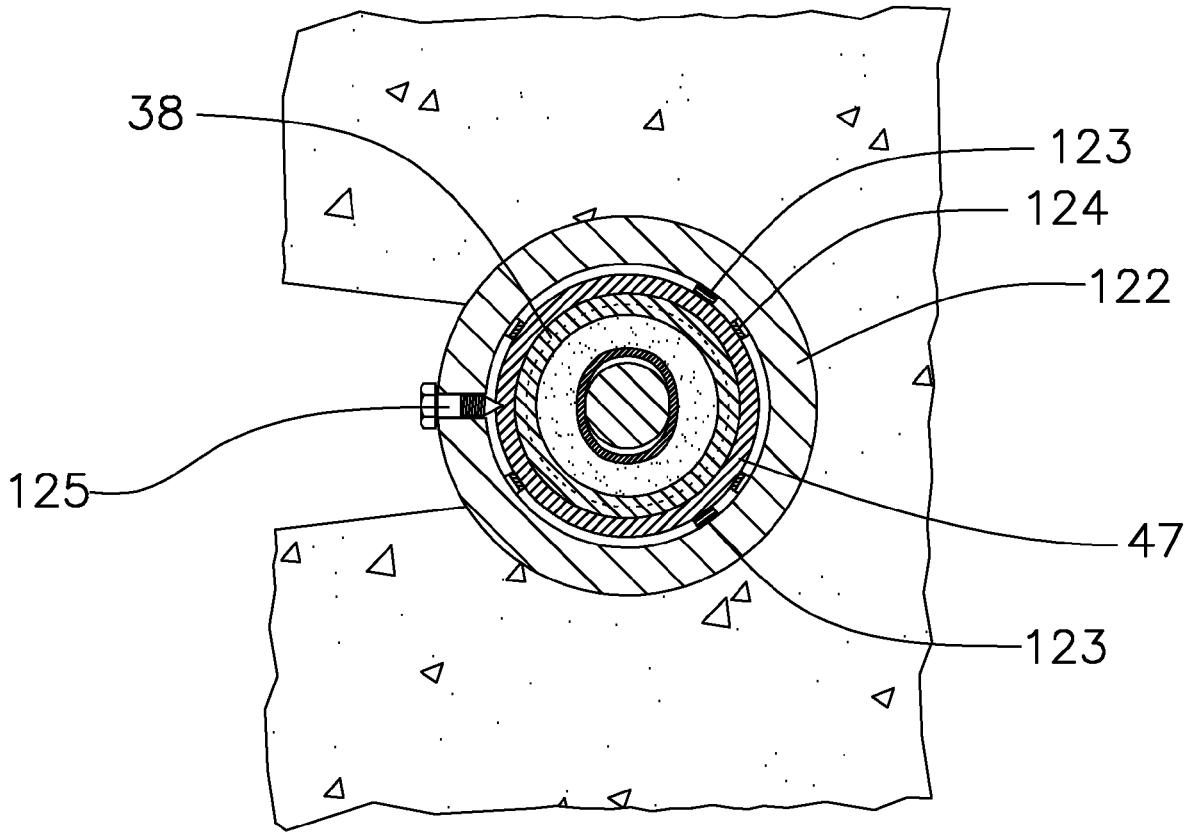
FIG. 14 is a cross-sectional view of the first embodiment as referenced in FIG. 7.

FIGS. 7 and 14 illustrate an alternative means of connecting the resisting element casing (38) to the transfer casing (68), by providing a resisting element connector block (47) similar to the previously described resisting element transfer block (46), with the omission of the internally threaded holes (48). The transfer casing transfer block (70) is replaced with a friction connector (122), inserted between and welded to separate transfer casing segments (68). The friction connector (122) is provided with coupling guide plates (124) to ensure the clear passage of resisting element casing segments (38) through the friction connector (122). Serrated rails (123) and friction screws (125) provide the load transfer. One or more extraction screws (126) may also be provided to ensure that the frictional connection can be disengaged once it has been connected. The friction connector (122) is further provided with holes for the friction screws (125) and the Extraction screws (126). The length and thickness of the friction coupling device (26C), as well as the number and size of the friction screws (125), serrated rails (123) and welds is based on the forces to be transmitted, among other things. While the components of the alternative friction connector (122) have been described, those skilled in the art will immediately recognize that such devices are used regularly in the reinforced concrete construction industry. One such example is the "BAR-LOCK rebar Coupler System", manufactured by the Dayton Superior Corporation of Dayton, Ohio.

One end of the transfer casing (68) segments is provided with a guide collar (82), comprised preferably of a steel cylindrical section welded to the transfer casing (68). The inside diameter of the guide collar (82) should preferably be only slightly larger than the outside diameter of the adjoining transfer casing (68). This dimension need only facilitate placement of the adjoining transfer casing (68), considering any fabrication and installation tolerances. A compressible ring (84), preferably comprised of soft rubber, with ring flanges (86) is placed within the guide collar (82). The thickness and properties of the compressible ring (84) should preferably be sufficient to ensure that longitudinal forces are not transmitted through adjoining transfer casing (68) segments. The ring flanges (86) ensure that the compressible ring (84A) is maintained in the correct position with respect to adjoining transfer casing segments, as well as ensuring that the compressible ring (84) does not dislodge from the transfer casing (68) and fall into the space between the transfer casing (68) and the resisting element casing (38). Alignment plates (88A and 88B) are welded to the adjoining transfer casing (68) and guide collar (82) to ensure proper alignment of successive transfer casing (68) segments. The alignment plates (88A and 88B) are provided in complimentary sets, and may be provided with alignment plate holes (90) through which a fattener may be placed to ensure alignment is maintained. Two alignment plates (88A) are provided on each side of the guide collar (82), and one complimentary alignment plate (88B) is provided at each location on the transfer casing (68) segment to be placed into the guide collar (82). The alignment plates (88A) on the guide collar (82) should preferably be spaced enough to accept the complimentary alignment plates (88B) with allowance for installation and fabrication tolerances.

The transfer casings (68), so prepared as described above, are installed into the formwork of the concrete structure, prior to concrete placement; along will all other reinforcement, embedments and the like. Access holes (92A), or block-outs as they are also called, are formed at each transfer casing transfer block (70). The access hole (92A) forms should preferably be made to fit tightly to the transfer casing transfer blocks (70), so as to ensure that no concrete, cement paste, or any other foreign object is able to damage any part of the transfer casing transfer block (70), or enter the space between the transfer casing (68) and the resisting element casing (38). At the fixed-end of the apparatus, a fixed-end access hole (92B) is provided to allow for connecting the resisting element casing (38) located at the fixed-end to an anchoring element (60). During construction, any open ends of the transfer casing (68) segments should preferably be temporarily capped, or otherwise covered, to ensure that no material enters the transfer casing (68). Prior to placing successive transfer casing (68) segments, any such caps or covers are removed, and the a compressible ring (84) is inserted into the guide collar (82). The next transfer casing (68) segment is then lowered onto the previously installed transfer casing (68) segment, into the guide collar (82), and onto the compressible ring (84). The alignment plates (88) are used to facilitate proper alignment of the adjacent transfer casing (68) segments. The transfer casing (68) segment may then be secured for concrete placement. Successive transfer casing (68) segments are thus placed with the progressing construction. The open, or free-end, of the transfer casing (68) is provided with a removable protective cap (13) for any future installation and removal of the resisting element casing (38).

Figure 8:
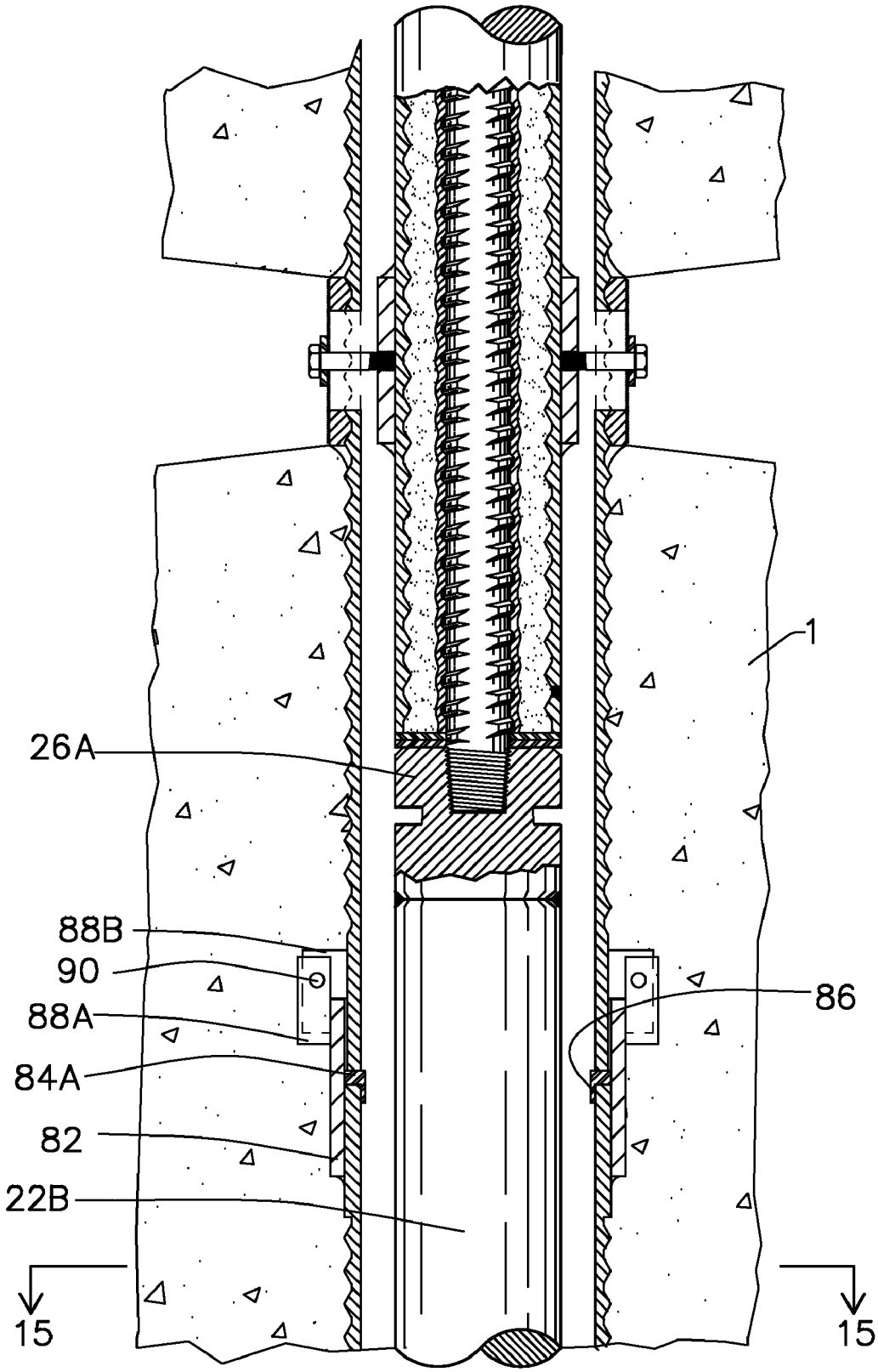
FIG. 8 is a longitudinal sectional view of the first embodiment located at the interface between the damped constrained length and un-damped free length portions of the apparatus.
Figure 9:
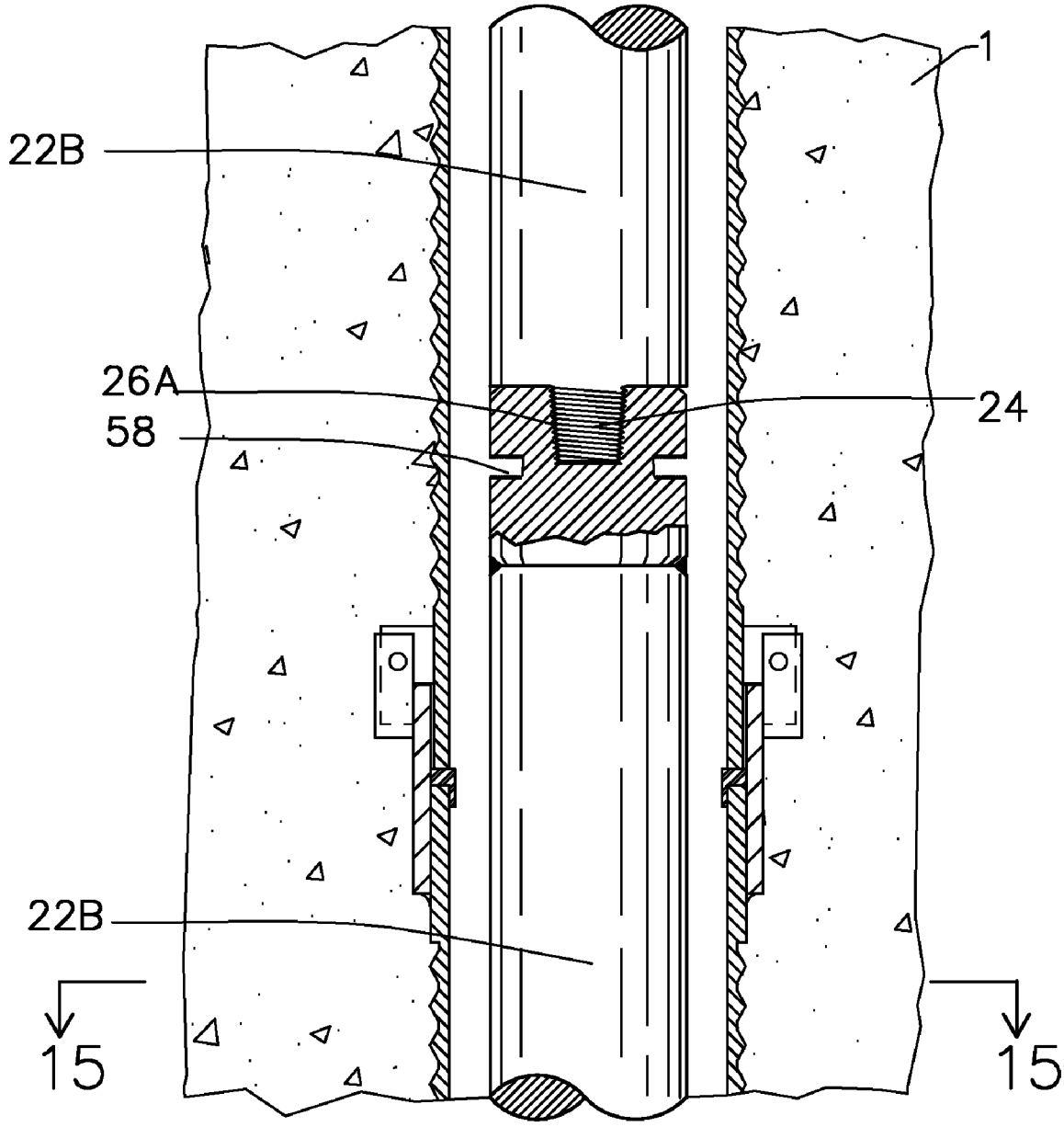
FIG. 9 is a longitudinal sectional view of the first embodiment located within the un-damped free length portion of the apparatus.
Figure 15:
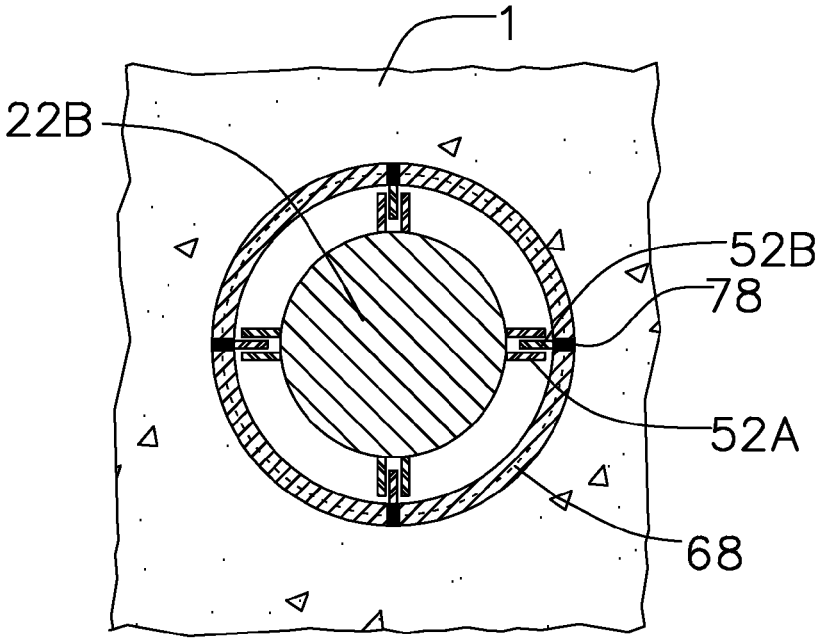
FIG. 15 is a cross-sectional view of the first embodiment as referenced in FIG. 9.
Figure 16A:
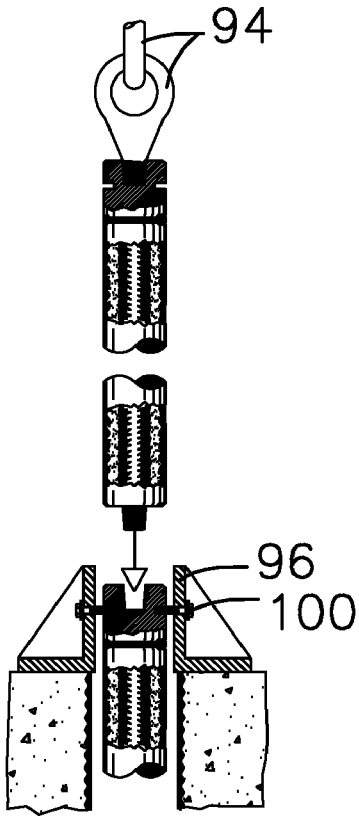
FIG. 16A is a longitudinal sectional view of the installation method of the first embodiment.
Figure 16B:
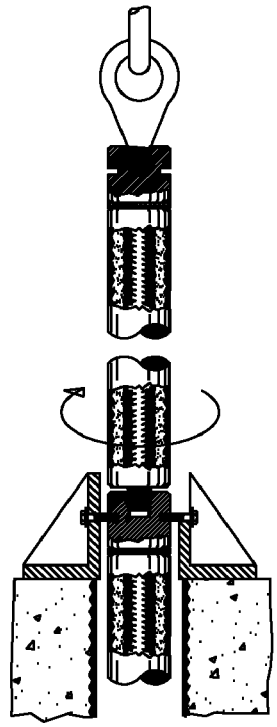
FIG. 16B is another longitudinal sectional view of the installation method of the first embodiment.
Figure 16C:
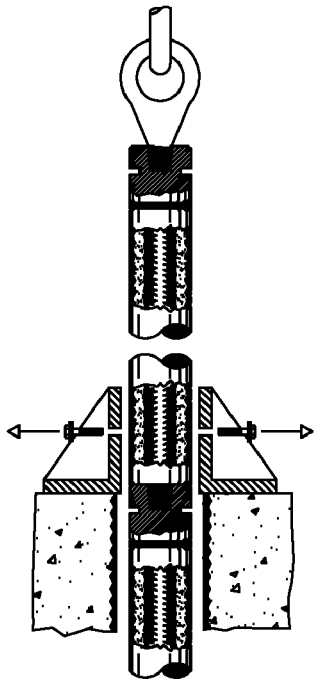
FIG. 16C is yet another longitudinal sectional view of the installation method of the first embodiment.
Figure 16D:
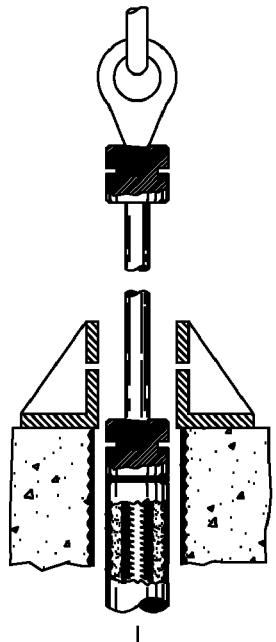
FIG. 16D is yet another longitudinal sectional view of the installation method of the first embodiment.

Referring now to FIGS. 8-9, as well as FIG. 15, in the un-damped free length portion of the embodiment, the resisting element (22B) is preferable comprised of a solid steel bar. The resisting element (22B) may be provided with threaded ends for the same coupling device (26A) provided similarly for the previously described resisting element segments in the damped constrained length portion (22A). The Coupling device (26A) may be alternatively welded onto one end of the resisting elements (22B). The resisting element (22B) as well as the complimentary transfer casing (68) may be provided with additional guide plates (52A & 52B) to ensure proper alignment and lateral stability of the resisting element (22B)

Figure 10A:
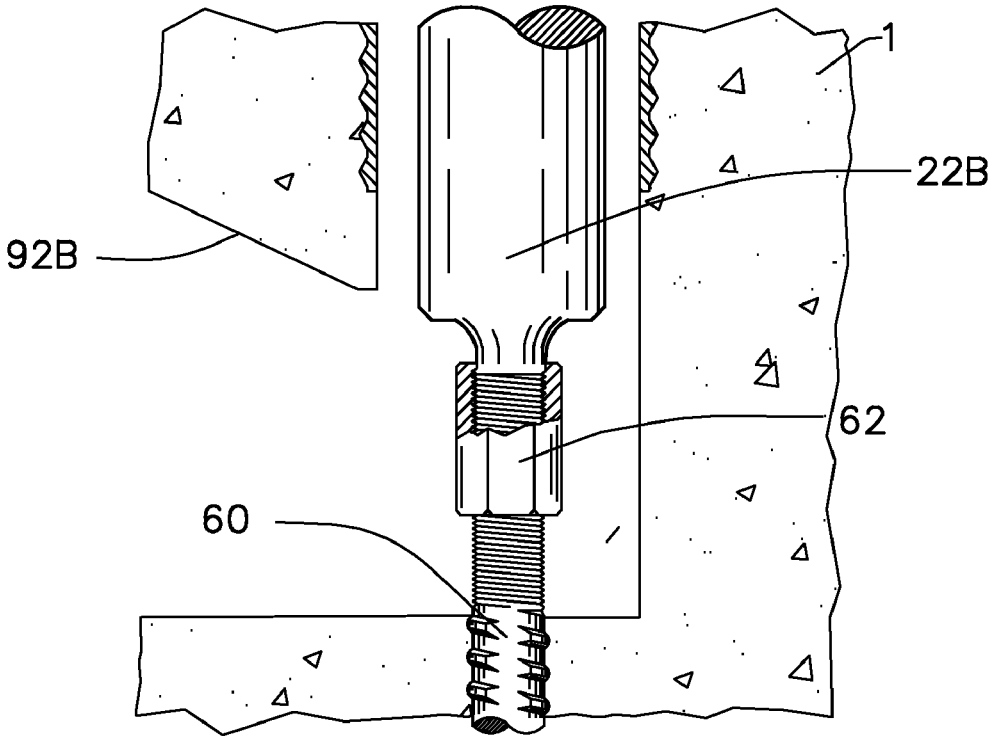
FIG. 10A is a longitudinal sectional view of the first embodiment located at the fixed end of the apparatus.
Figure 10B:
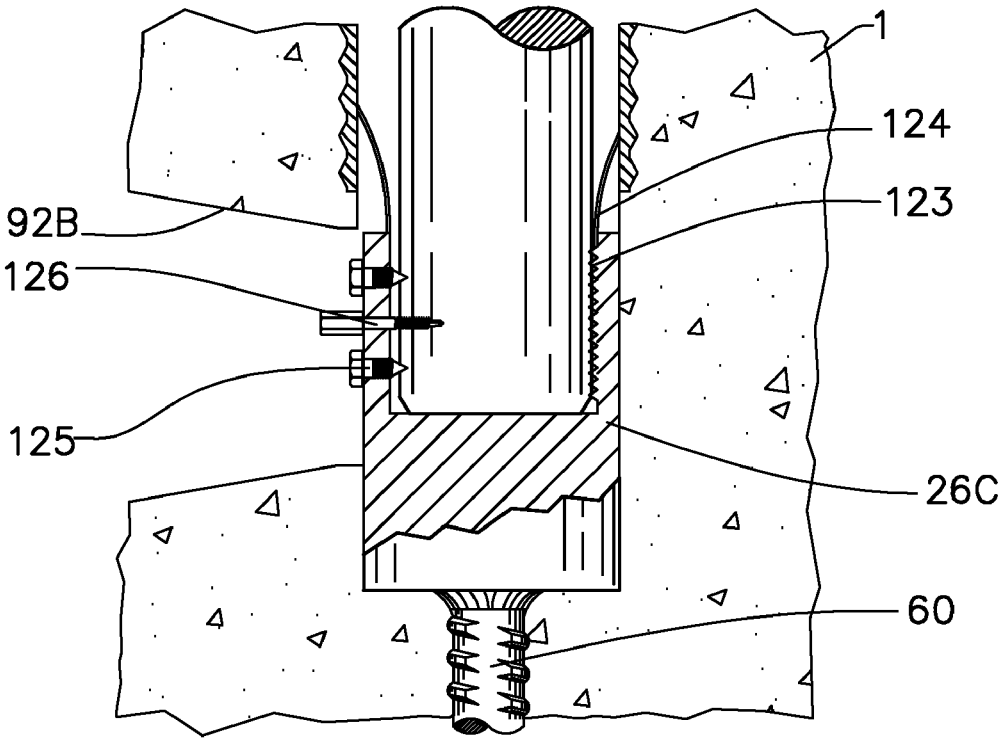
FIG. 10B is a longitudinal sectional view of an alternative anchorage means for the first embodiment located at the fixed end.
Figure 11:
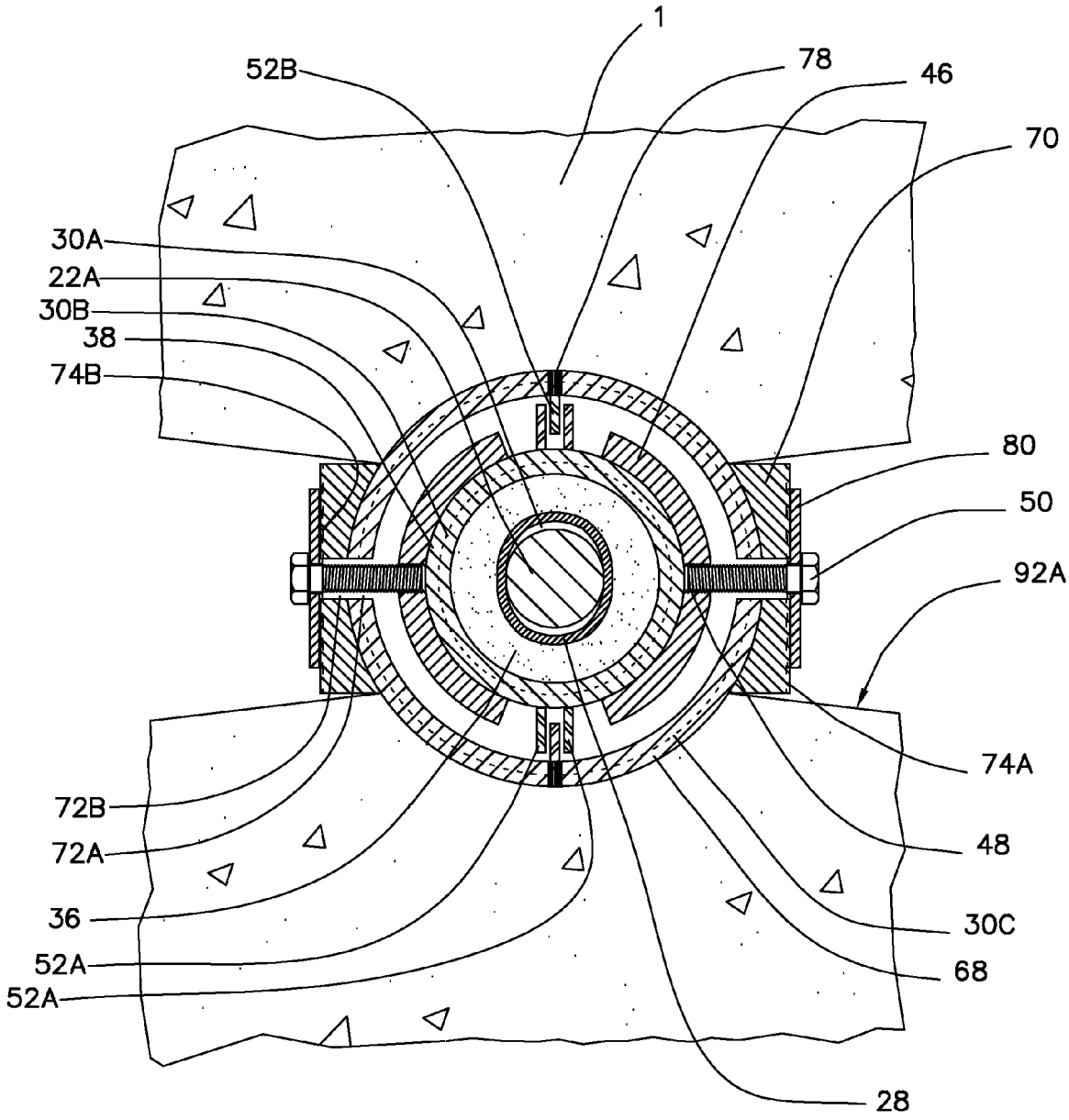
FIG. 11 is a cross-sectional view of the first embodiment as referenced in FIG. 6
Figure 12:
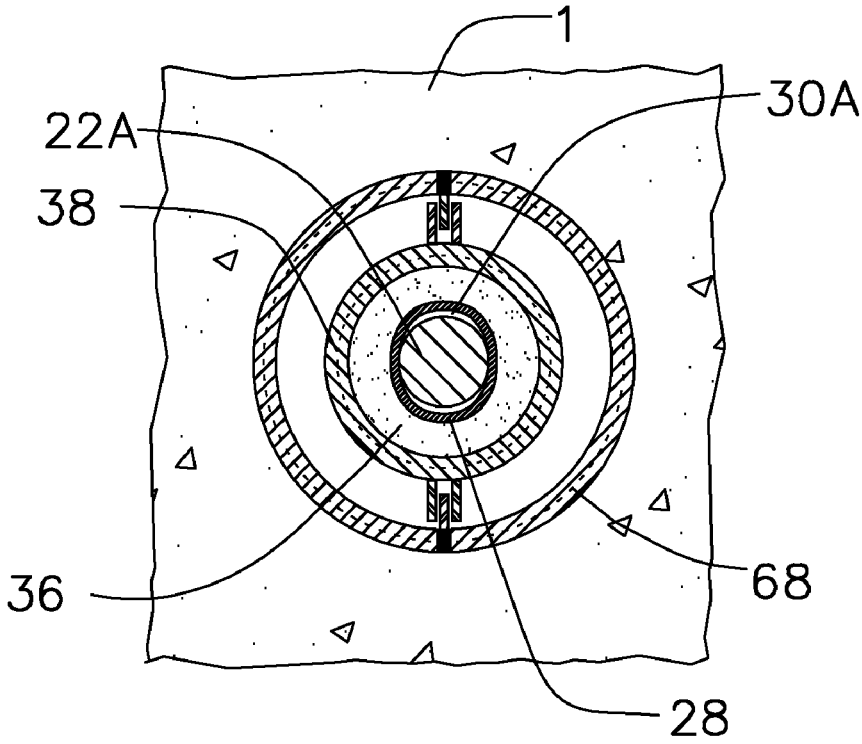
FIG. 12 is a cross-sectional view of the first embodiment as referenced in FIG. 6
Figure 13:
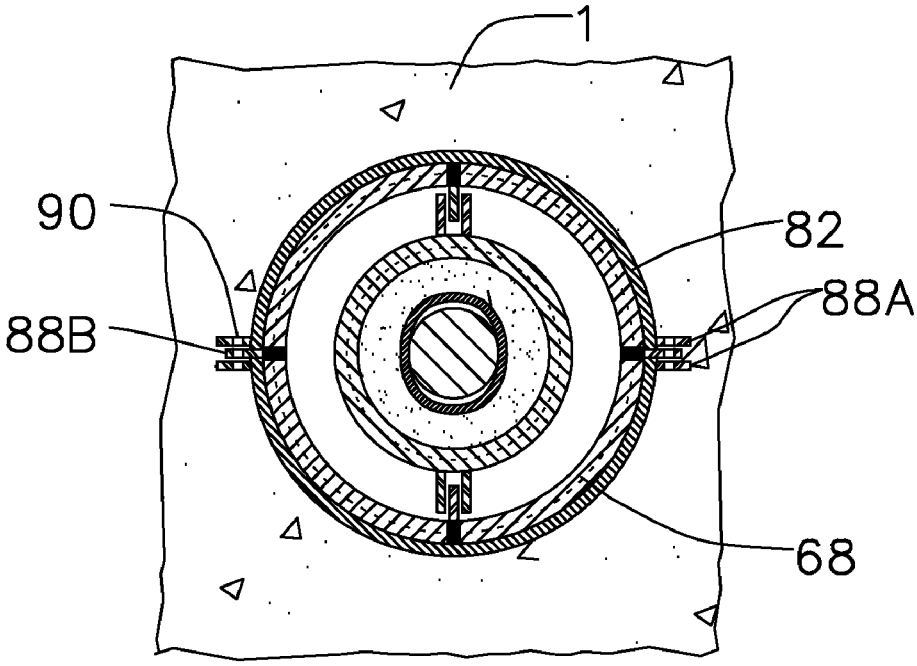
FIG. 13 is a cross-sectional view of the first embodiment as referenced in FIG. 6.

Referring now to FIGS. 10A & 10B, at the anchored, or fixed, end of the resisting element (22B), an anchoring element coupling device (62), preferably a standard internally threaded steel coupler, connects the resisting element (22B) to the anchoring element (60). The anchoring element (60) is preferably a deformed steel bar embedded into the structural element (1). The anchoring element coupling device (62) should preferably permit the resisting element (22B) segment to be connected with the anchoring element (60) without the need to twist, rotate or screw the resisting element (22B) into the anchoring element coupling device (62). This may be accomplished by further providing the anchoring element coupling device (62), which can be threaded fully onto the anchoring element (60) through the full length of the anchoring element coupling device (62), and then reverse rotated, or back threaded, onto the reverse threaded end of the resisting element (22B). Alternatively, a friction coupling device (26C) similar to the friction connector (122) described above may be used, whereby the friction coupling device (26C) may be attached to the anchoring element (60) preferably by welding.

Referring now to FIGS. 16A-16D, with reference also FIGS. 5-10, at any time during or after construction of the structural element (1), the resisting element casing (38) segments may be installed by coupling successive resisting element casing (38) segments at the free-end, and lowering the thus coupled resisting element casing (38) segments into the transfer casing (68) assembly having been so constructed with the structural element (1). This may be accomplished by the following means:

A lifting device (94), which is capable of ultimately supporting the weight of all resisting element casing (38) segments to be installed between the free-end and the fixed-end. Casing suspension brackets (96) may be provided at the free-end to provide temporary support for the resisting element casing (38) segments by installing temporary casing suspension bolts (98) through bolt holes (100) in the casing suspension brackets (96) and into the complimentary internally threaded bores (58) in the coupling device (26). Once the successive resisting element casing (38) segment, or assembly of segments, is fully coupled to the resisting element casing (38) segment being immediately supported by the casing suspension brackets (96), the casing suspension bolts (98) may be removed, as the lifting device (94) would be capable of supporting the loads of all resisting element casing (38) segments installed. The lifting device (94) may then be used to lower the assembly of resisting element casing (38) segments until the upper-most set of internally threaded bores (58) in the coupling device (26) come into alignment with the complimentary bolt holes (100) in the casing suspension brackets (96). The casing suspension bolts (98) may then be installed, and the process of installation is thus repeated.

After the final resisting element casing (38) segment has been installed, but before the casing suspension bolts (98) and lifting device (94) are removed, the connection of the resisting element casing (38) segment at the fixed-end is made to the anchoring element (60). Such connection is made by reverse threading the coupling device (26) installed on the anchoring element (60) onto the complimentary threaded end of the fixed-end resisting element (22B), as described above. All transfer bolts (50) may then be installed. However, the transfer bolts (50) are preferably to remain loose enough so as not to engage the serrations (74A) on the transfer casing transfer blocks (76) with the serrations (74B) on the plate washers (80), thus still allowing vertical movement within the slotted holes (72A and 72B). After all transfer bolts (50) are so installed, the casing suspension bolts (98) may be removed and the lifting device (94) may be slowly released, thus allowing the entire assembly of resisting element casing (38) segments to be entirely self supported from the fixed-end (64). Those skilled in the art will appreciate that upon releasing the lifting device (94), there will be a shortening of the resisting element casing (38) assembly. Once this shortening has taken place, the transfer bolts (50) may be fully installed to engage the serrations (74B) on the plate washers (80) with the serrations (74A) on the transfer casing transfer blocks (70) in their force-transmitting manner. However, as descried previously, it may be desirable and beneficial to delay making these connections until some later time.

Now, with reference to the figures and description provided above, the method and manner by which the apparatus of the first embodiment, thus comprised and installed, functions is described, where:

The transfer casing (68) is attached to the structural element (1) in a force-transmitting manner by way of deformations (30C) on its external surface. The transfer casing (68) is provided with transfer casing transfer blocks (70) having surface serrations (74A) on its outer face. The compressible rings (84), placed between successive transfer casing (68) segments, ensure that minimal force can be transmitted directly between successive transfer casing (68) segments.

The resisting element (22A), in the damped constrained length portions of the resisting element means, is enveloped with a damping material (28). The resisting element casing (38) is provided with deformations (30B) on its interior surface and is provided with resisting element transfer blocks (46), having internally threaded holes (48). The so enveloped resisting element (22A) is connected to the resisting element casing (38) by grout (36), placed between the resisting element casing (38) and the damping material (28).

The resisting element (22A) and resisting element casing (38) segments, so comprised, are connected to adjacent segments by way of coupling devices (26) The compressible gaskets (84), placed between successive resisting element casing (38) segments, ensure that minimal forces can be transmitted directly between successive resisting element casing (38) segments The transfer casing (68) is connected to the resisting element casing (38) by way of transfer bolts (50). The transfer bolts (50) are installed through plate washers (80), having serrations (74B) complimentary to the serrations (74A) on the transfer casing transfer blocks (70). The transfer bolts (50) pass through the slotted holes (72A and 72B) in both the transfer casing transfer blocks (70) and the transfer casing (68) and are screwed into the internally threaded holes (48) in the resisting element transfer blocks (46). When the transfer bolts (50) are tightened, the serrations (74B) on the plate washers (80) engage, or interlock, with the complimentary serrations (74A) on the transfer casing transfer blocks (70), thus providing a force-transmitting mechanism.

The resisting element (22A) is attached directly to the structural element (1) at one end, referred to as the fixed-end, by way of the anchoring element coupling device (62) attached to the anchoring element (60), which is embedded into the structural element (1). Within the damped constrained length portion, the resisting element (22A) is indirectly attached to the structural element (1) through and by the component means described above. Elsewhere, through the un-damped free length portion, the resisting element (22B) is free to move longitudinally with respect to the structural element (1). In this way any forces transmitted between the structural element (1) and the resisting element (22A) pass through the damping material (28).

When a dynamic force is applied to the structural element (1), such as may result from wind or earthquakes, there will be a strain in the structure, in a direction parallel with the longitudinal direction of the resisting element (22A & 22B). Because the resisting element (22A 7 22B) is a continuous structural element, connected to the structural element (1) in a force-transmitting manner, through and by the component means described previously, a substantial portion of this strain will be transferred into the resisting element (22A & 22B). Those skilled in the art will appreciate that the resisting element (22A & 22B) will tend to resist this strain in proportion to its longitudinal stiffness, relative to the stiffness of the structural element (1). This basic engineering concept of "strain compatibility" would be recognized and understood by those skilled in the art. According to the apparatus of the first embodiment, the resisting element (22A) and the structural element (1) are linked in a shear mode by and through the damping material (28) layer, among other things. In this way, the forces and deformations within the structure will result in a relative shear force between the structural element (1) and resisting element (22A), a substantial portion of which is ultimately transmitted by and through the damping material (28) layer. In transmitting such a force through the damping material (28) layer, a portion of the energy associated with such a force is dissipated.

Although the properties of damping materials, such as viscoelastic damping materials, are typically characterized by their shear storage modulus and loss factor, within a range of frequency and temperature, among other things, those skilled in the art will understand that these properties are really a condensed representation of the more general load-displacement behavior of such materials. Until recently, only simplified methods of analysis for relatively simple structures were available for assessing the behavior and contribution of such damping materials. Those skilled in the art will understand that any accurate analysis and assessment of the contribution of energy dissipation systems and devices on the damping behavior for real structures should preferably consider the nonlinear constitutive relationships of the materials comprising the structure and the damping device. The assessment of the behavior of such damping devices or systems on the overall behavior of complex structures is best accomplished by utilizing so-called nonlinear dynamic analysis. In this regard, it is important to define the damping material properties in a form that can be incorporated into such an analysis. Those skilled in the art will understand that the preferable measurement of these properties, for this purpose, is to define their load-deformation relationships. These relationships may be dependent on the frequency, temperature and strain amplitude, and are directly related to the thickness of the damping layer, as well as its surface area. Such relationships can be reliably modeled for structural analysis with commercially available computer software such as SAP 2000 and ETABS, by Computers and Structures, Inc. of Berkeley, Calif. Thus, the optimal properties of the damping material can be determined reliably and accurately by using an iterative design process with nonlinear dynamic analysis. This process will be well understood by those skilled in the art. Recommendations and guidelines for analysis and design of such energy dissipation systems are also provided by such organizations as the Federal Emergency Management Agency (FEMA) and National Earthquake Hazards Reduction Program (NEHRP), to name a few.

In a second embodiment, when it is neither necessary nor required to provide the resisting element (22B) in the undamped free length portion with a means of installation or removal after construction of the structural element (1), the energy dissipation provided by the first embodiment can be similarly achieved as described now.

Figure 17:
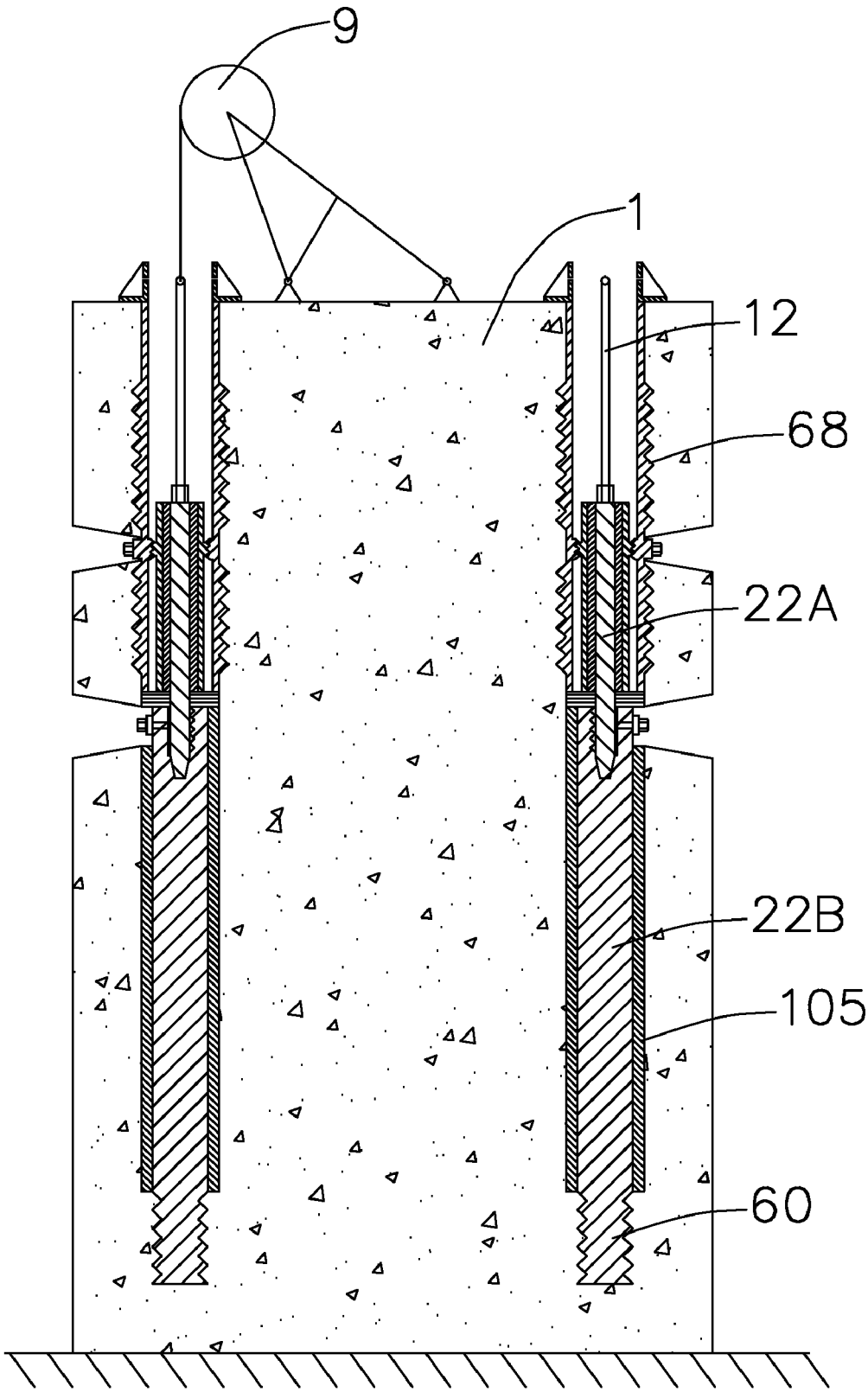
FIG. 17 is an elevational sectional view of the principle arrangement of the second embodiment.

FIGS. 17-21 illustrate the second embodiment, where FIG. 17 depicts the general arrangement of the component means for reference to the detailed component descriptions now provided.

Those skilled in the art will recognize that many of the features of the first embodiment will be similar in the second embodiment. Where these features are substantially similar, and further description is not required to enable one skilled in the art to make and use the second embodiment, such similar detailed descriptions will not be repeated.

Figure 18:
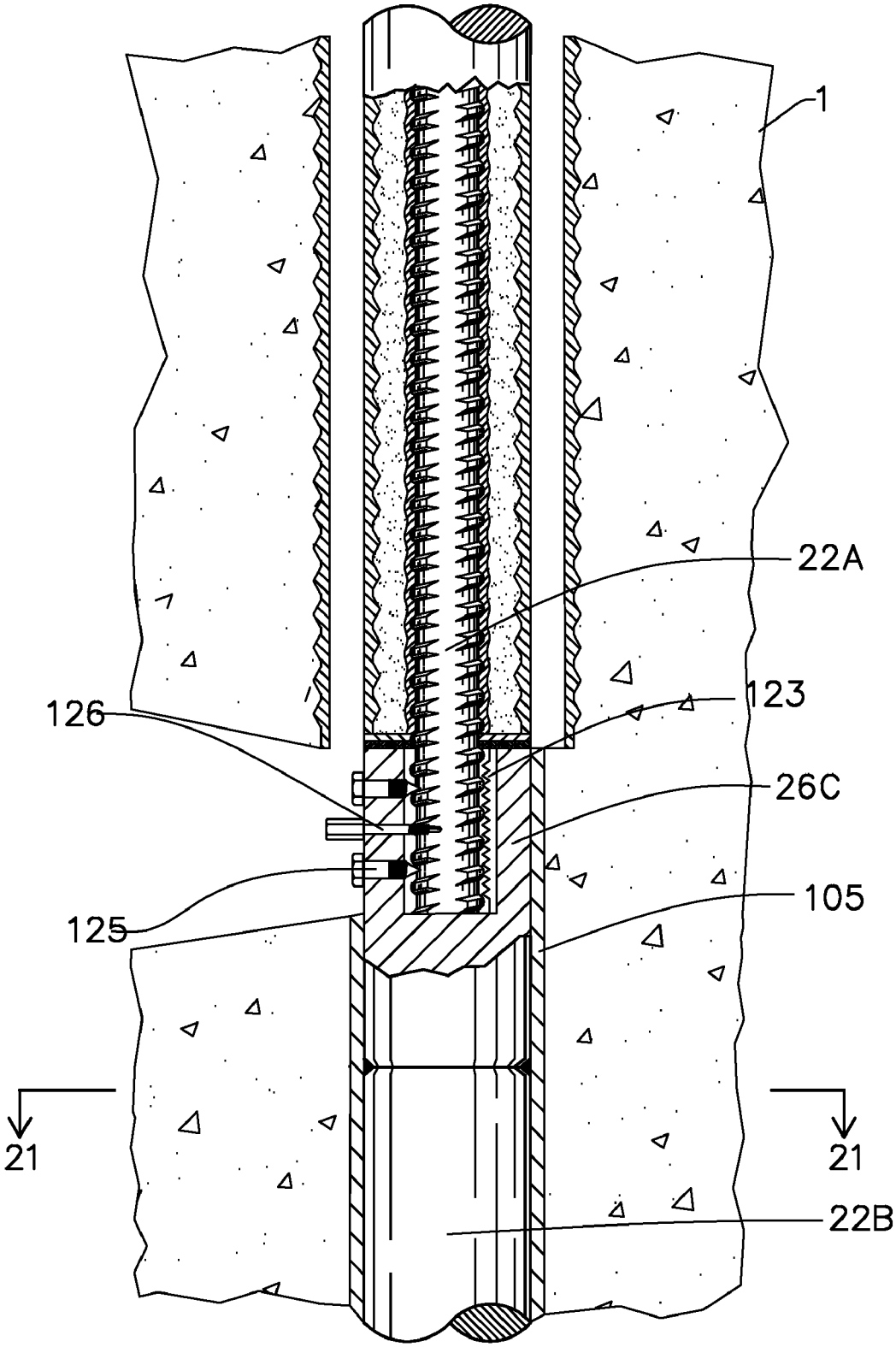
FIG. 18 is a longitudinal sectional view of the second embodiment located at the interface between the damped constrained length and un-damped free length portions of the apparatus.

Referring now to FIGS. 18-21, the resisting elements (22A and 22B), in the second embodiment are similar to those in the first embodiment, except that in the second embodiment, the resisting element (22B) in the un-damped free length portion is surrounded with a non-communicating sleeve (105) which ensures unrestricted longitudinal movement of the resisting element (22B) with respect to the structural element (1), while maintaining stability in the transverse direction. Referring to FIG. 18, where the resisting element (22A) is connected to the resisting element (22B), the resisting element (22A) is provided with a portion of its length extending out from the resisting element casing (38). At this connection, the resisting element (22B) is provided with a friction coupling device (26C) similar to that used in the first embodiment for the connection of the resisting element (22B) to the anchoring element (60). This friction coupling device (26C) is preferably welded onto the resisting element (22B), and is provided with internal dimensions corresponding to the size of the resisting element (22A). As with the first embodiment, the length and thickness of the friction coupling device (26C), as well as the number and size of the friction screws (125), serrated rails (123) and welds is based on the forces to be transmitted, among other things.

Figure 19:
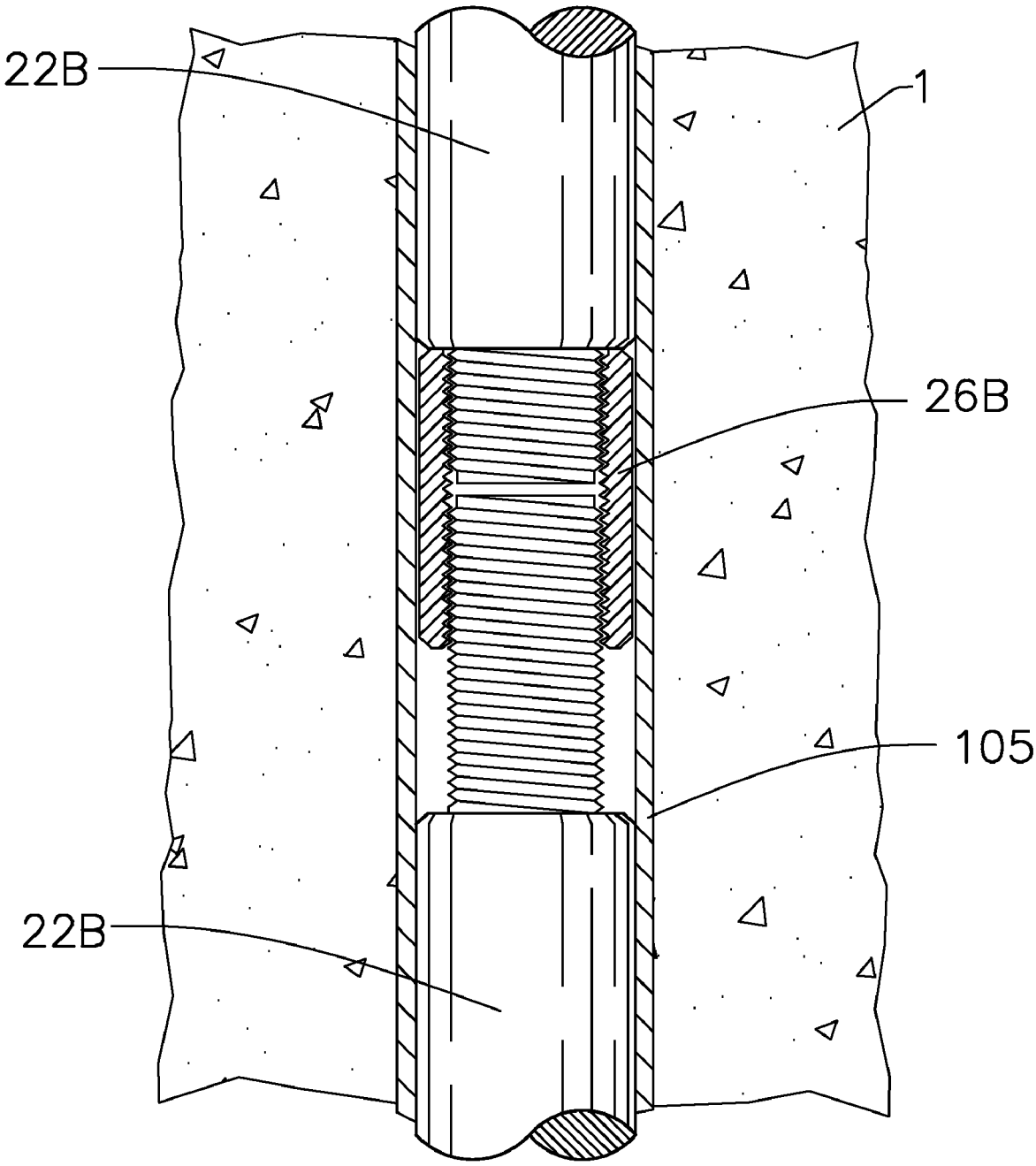
FIG. 19 is a longitudinal sectional view of the second embodiment located at the within the un-damped free length portion of the apparatus.

Referring to FIG. 19, where adjacent resisting element (22B) segments are connected to provide the continuous resisting element means of the embodiments, a coupling device (26B), preferably a standard internally threaded steel coupler is provided. The coupling device (26B) should preferably permit the resisting element (22B) segments to be connected without the need to twist, rotate or screw either resisting element (22B) into the coupling device (26B). This may be accomplished by further providing the coupling device (26B) and the resisting elements (22B) whereby the coupling device (26B) can be threaded fully onto the resisting elements (22B) through the full length of the coupling device (22B), and then reverse rotated, or back threaded, onto the reverse threaded end of the complimentary resisting element (22B).

Figure 20:
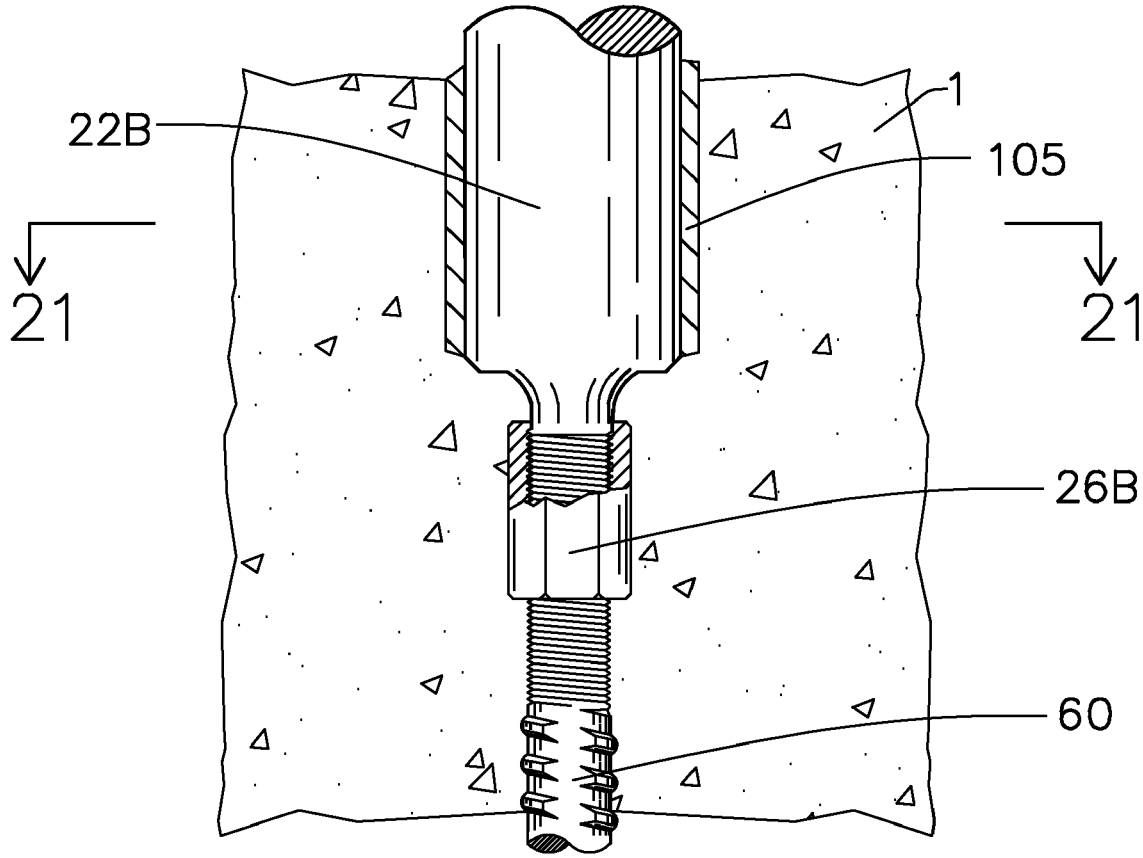
FIG. 20 is a longitudinal sectional view of the second embodiment located at the fixed end of the apparatus.
Figure 21:
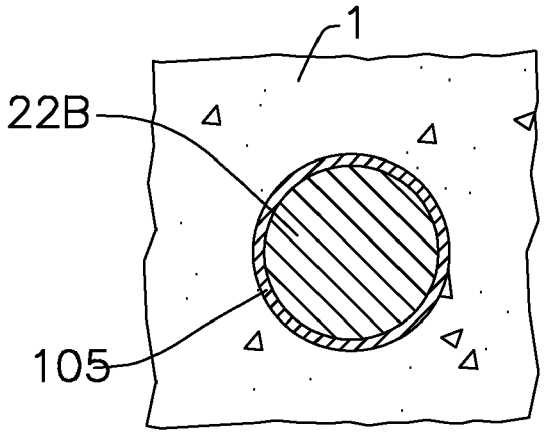
FIG. 21 is a cross-sectional view of the second embodiment as referenced in FIGS. 20 and 25

Referring now to FIG. 20, where the resisting element (22B) is anchored to the anchoring element (60), an anchoring element coupling device (62) similar to the coupling device (26B) just described above for the connection of adjacent resisting element (22B), is provided.

When a dynamic force is applied to the structural element (1), such as may result from wind or earthquakes, the second embodiment functions in the same manner as the first embodiment, where the resisting element (22A) and the structural element (1) are similarly linked in a shear mode by and through the damping material (28) layer, among other things.

In a third embodiment, when it is neither necessary nor required to provide any portion of the resisting element (22A & 22B) with a means of installation or removal after construction of the structural element (1), the energy dissipation provided by the first embodiment can be similarly achieved as described now.

Figure 22:
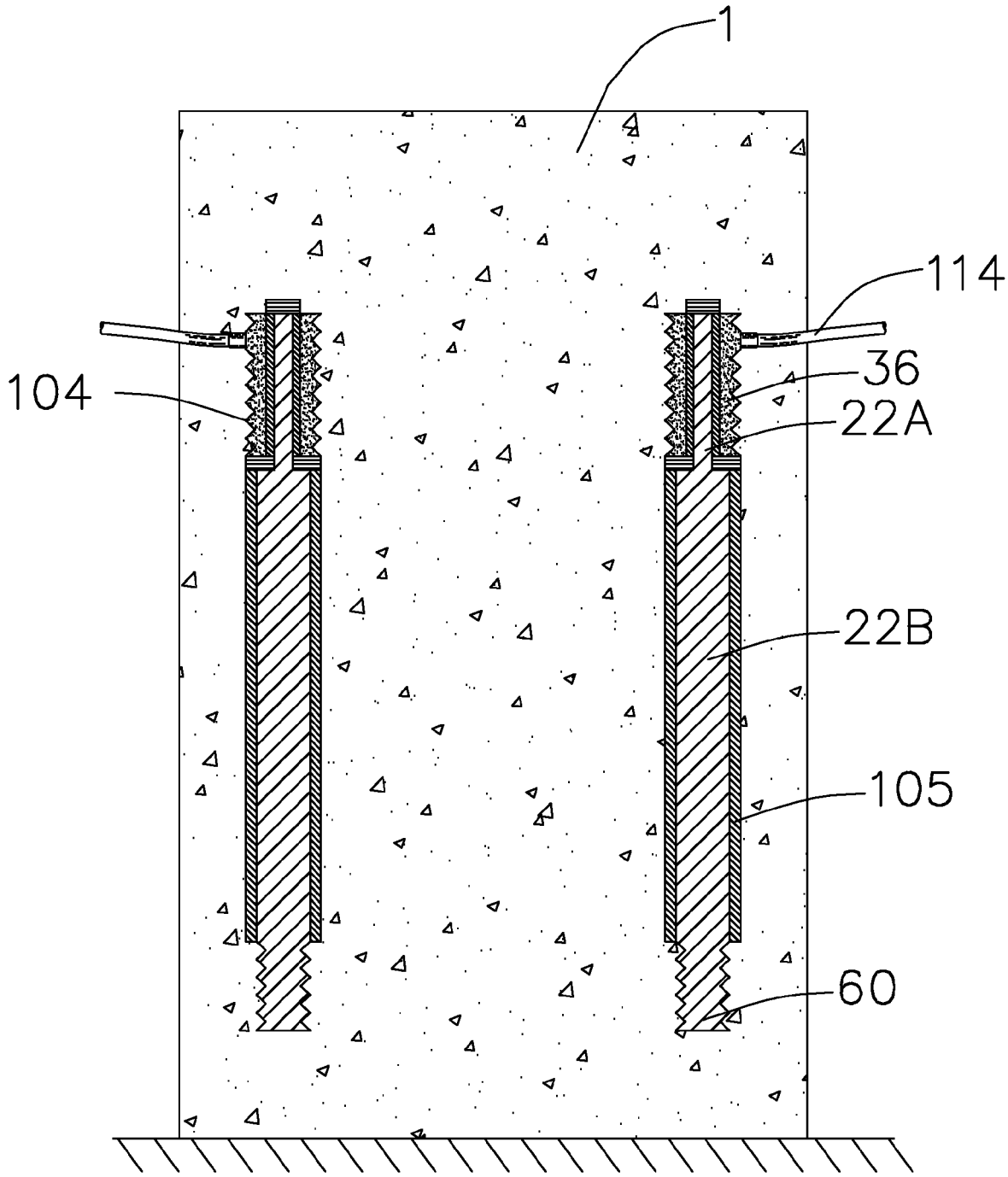
FIG. 22 is an elevational sectional view of the principle arrangement of the third embodiment.
Figure 23:
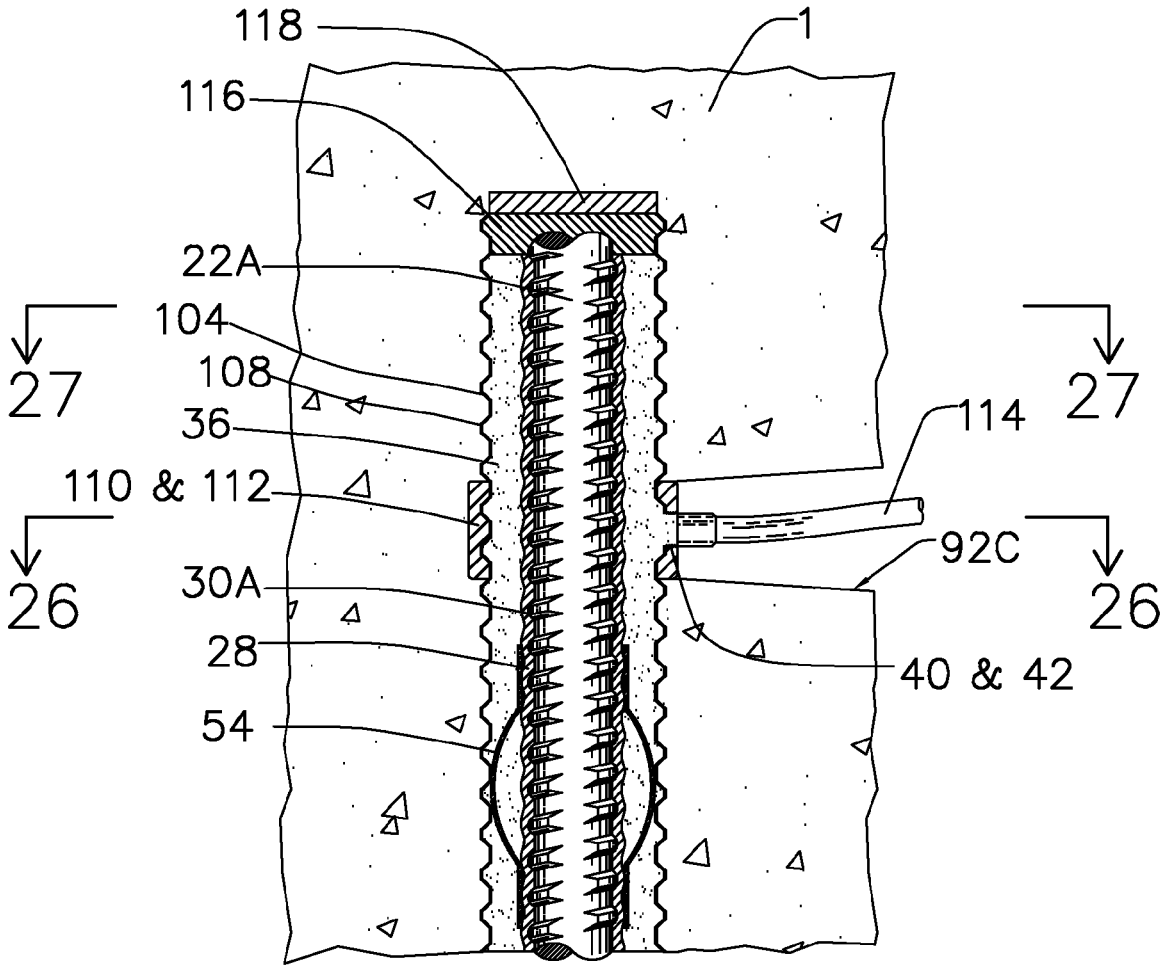
FIG. 23 is a longitudinal sectional view of the third embodiment located at the free end of the apparatus.
Figure 24:
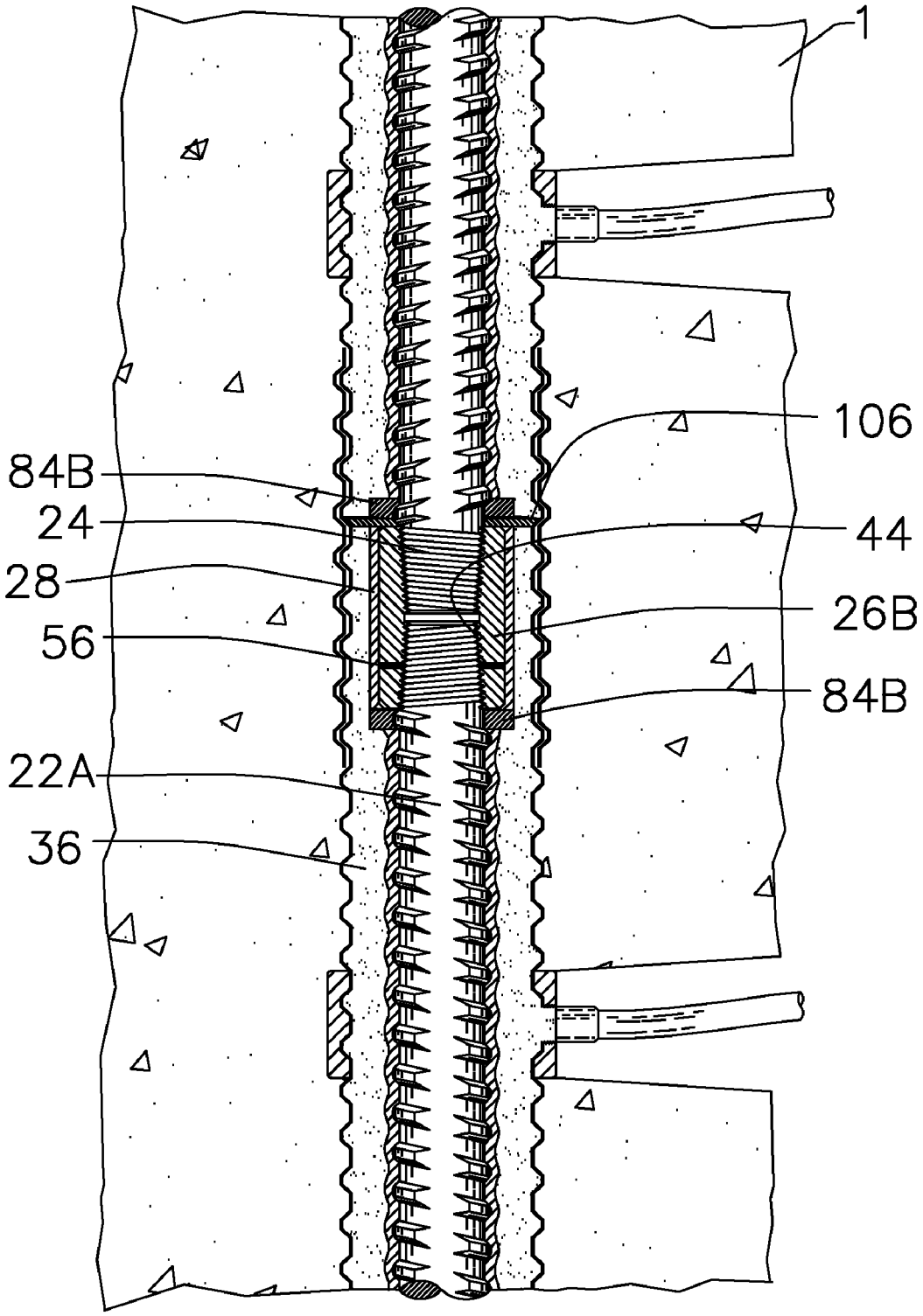
FIG. 24 is a longitudinal sectional view of the third embodiment located within the damped constrained length portion of the apparatus.

FIGS. 22-28 illustrate the third embodiment, where FIG. 22 depicts the general arrangement of the component means for reference to the detailed component descriptions now provided.

Those skilled in the art will recognize that some of the features of the second embodiment will be similar in the third embodiment. Where these features are substantially similar, and further description is not required to enable one skilled in the art to make and use the second embodiment, such similar detailed descriptions will not be repeated.

Referring now to FIGS. 23-28, the resisting element (22A) in the damped constrained length portion is similar to that provided in the first and second embodiments, except that the resisting element casing (38) and the associated resisting element coupling devices (26A) are omitted.

In the present embodiment, a duct (104) comprised preferably of corrugated steel cylindrical section is provided in approximately the same length segments as the resisting element segments. The actual length may depend on, among other things, the length of the resisting element (22A), the length of the coupling device (26B) and the thickness of any bulkhead plates (106), to be described later. The internal diameter of the duct (104) should preferably be of sufficient dimension so as to allow for the proper placement of grout (36) into the annular space between the duct (104) and the coupling device (26) and damping material (28). The internal diameter should preferably also allow for sufficient grout thickness to ensure the proper transmission of forces through the grout (36). The corrugations (108) should preferably be of sufficient size, orientation, depth and shape so as to provide adequate force transmission between the structural element (1) and the duct (104) and the duct (104) and the grout (36).

The duct (104) should preferably be of sufficient strength and stiffness to withstand internal pressure from grouting, as well as to retain its shape and integrity during transportation and installation. Some of the duct (104) segments may be provided with a grout inlet sleeves (110) and some duct (104) segments may be provided with a complimentary grout outlet, or vent, sleeves (112). Both the grout inlet sleeves (110) as well as grout outlet sleeves (112) are provided with port holes (40 and 42) for accepting grout tubes (114). The grout sleeves (110 and 112) are preferably comprised of the same material as the duct (104) and preferably have complimentary corrugations (108) with the duct (104). The grout sleeves (110 and 112) may be sealed by mechanical connections or adhesive tapes, among other things. Both the grout inlet sleeves (110) as well as grout outlet sleeves (112) are preferably provided with grout tubes (114), to aid in the placement of grout (36). The location and spacing of such sleeves (110 and 112) and tubes (114) will depend on the limitations of the grouting equipment. Such sleeves (110 and 112) and grout tubes (114)

are used regularly in the post-tensioning industry, and will be well known by those skilled in the art.

The ducts (104), so prepared as described above, are installed with the resisting elements (22A) into the formwork of the structural element, prior to concrete placement, along will all other reinforcement, embedments and the like. Access holes (92C), or block-outs as they are also called, may be formed at each grout sleeve (110 and 112), to aid in the placement of grout (36). Prior to placing successive duct (104) and resisting element (22A) segments, the complimentary compressible ring (84B) is inserted onto the previously installed coupling device (26B). The resisting element (22A) is then screwed, or threaded, into the previously installed coupling device (26B). Bulkhead plates (106) may also be installed on the coupling device (26B) where it is desired to limit the extent of grouting during placement.

The complimentary duct (104) segment is then lowered to meet the previously installed duct (104) segment, and a duct coupling sleeve (120) is attached to both segments. The duct coupling sleeve (120) is preferably comprised of the same material as the duct (104) and preferably has complimentary corrugations (108) with the duct (104). The duct coupling sleeve (120) may then be sealed by mechanical connections or adhesive tapes, among other things.

The so installed duct (104) and resisting element (22) may then be secured for concrete placement. Successive duct (104) and resisting element (22) segments are thus placed with the progressing construction. The free-end of the free-end duct (104) segment is preferably capped with a cap plate (118). Also, a compressible filler material (116) is preferably placed between the free-end of the resisting element (22) and the cap plate (118). The compressible filler material (116) ensures that minimal force may be transmitted from the structural element (1) to the resisting element (22) through the cap plate (118).

Figure 25:
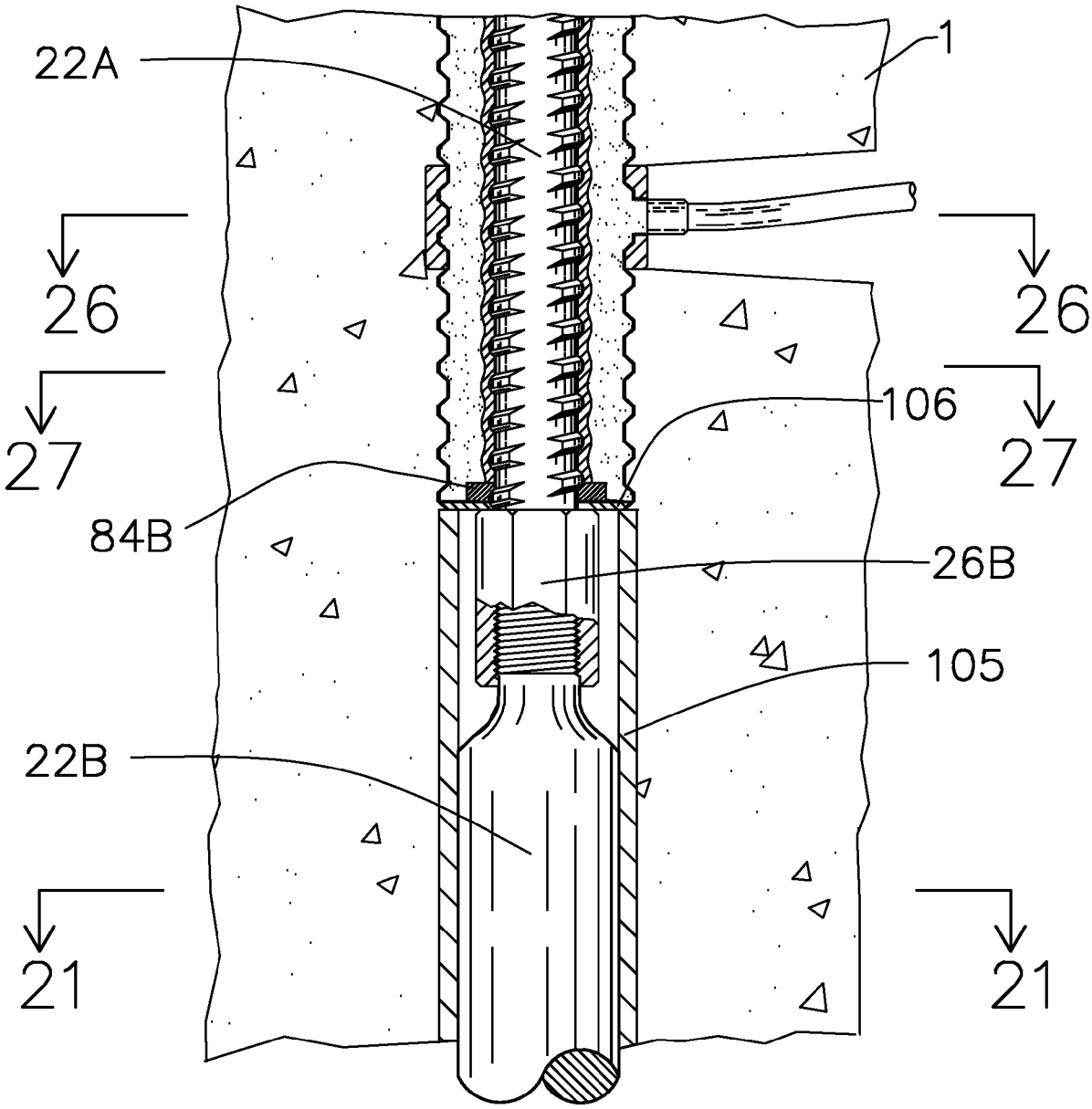
FIG. 25 is a longitudinal sectional view of the third embodiment located at the interface between the damped constrained length and un-damped free length portions of the apparatus.
Figure 26:
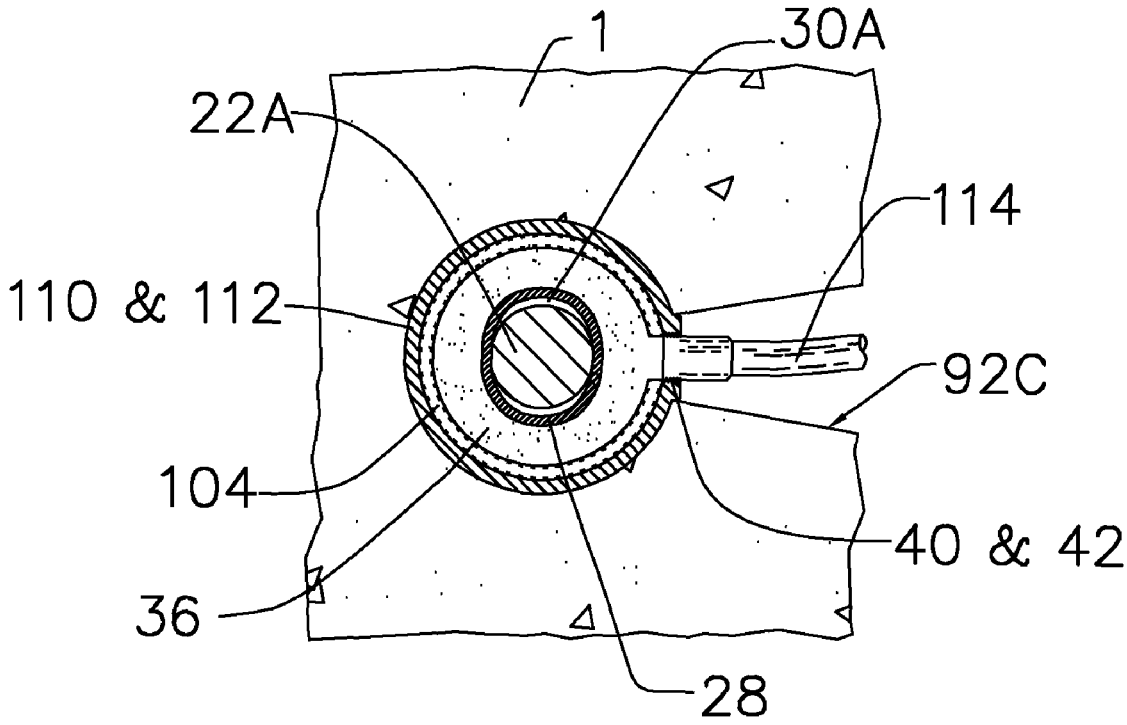
FIG. 26 is a cross-sectional view of the third embodiment as referenced in FIG. 25
Figure 27:
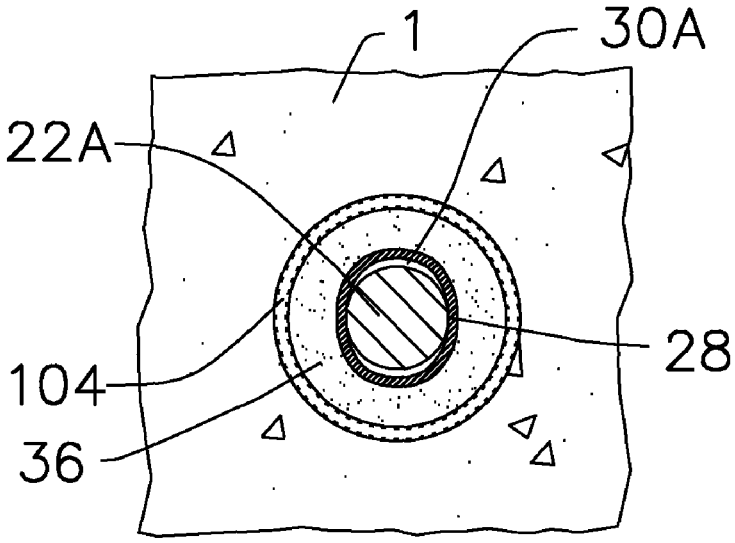
FIG. 27 is a cross-sectional view of the third embodiment as referenced in FIG. 25
Figure 28:
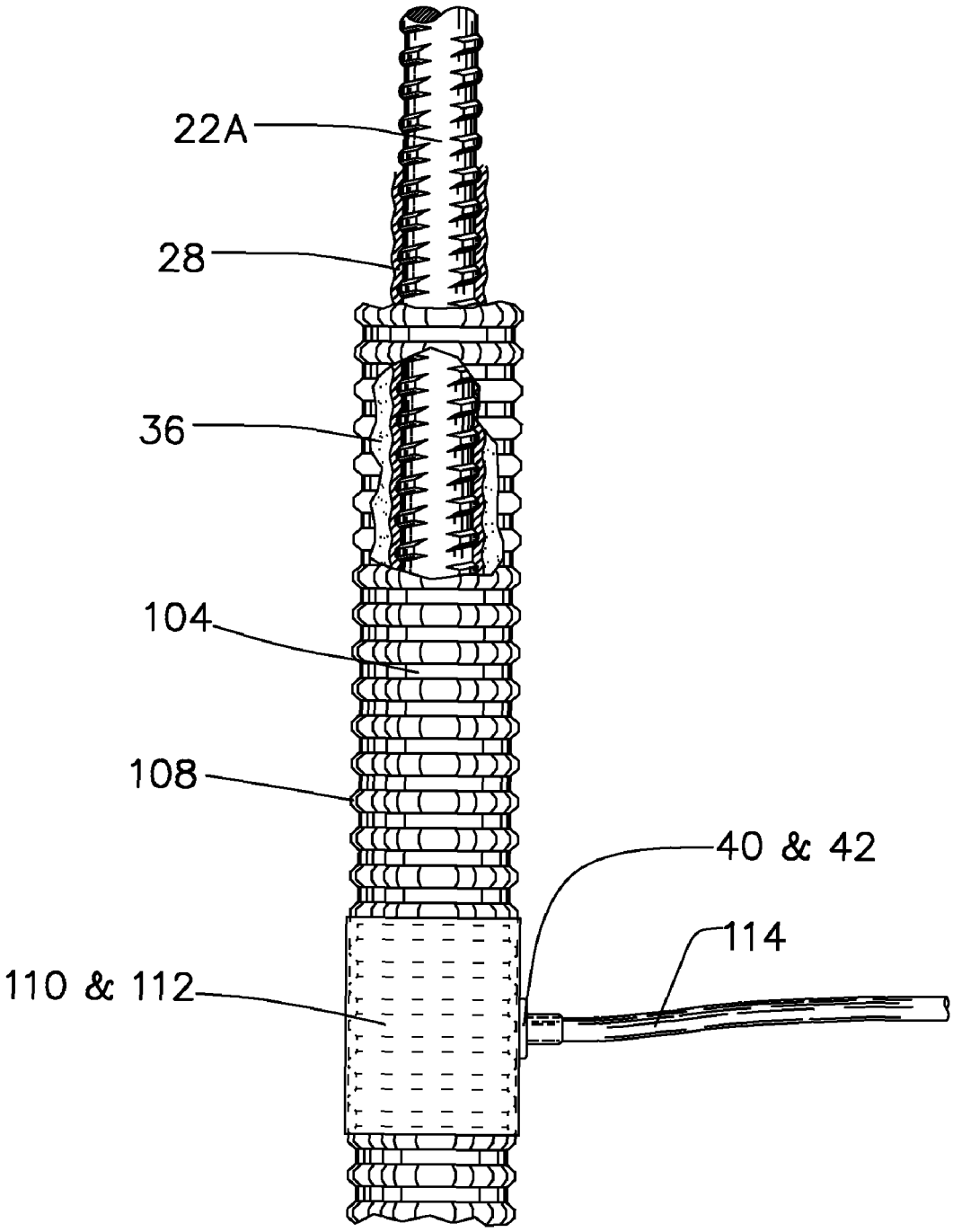
FIG. 28 is an elevational sectional view of the third embodiment showing the principle relationships of the components in the damped constrained length portion.
Figure 29:
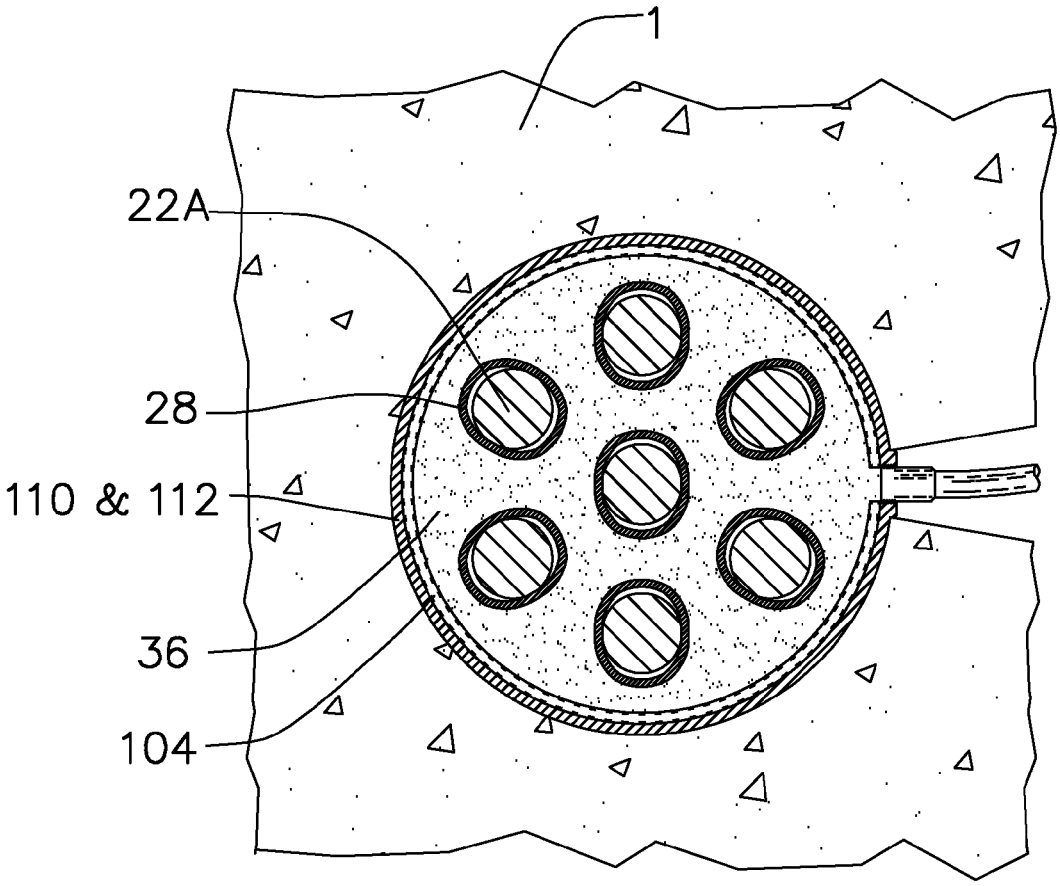
FIG. 29 is a cross-sectional view of an alternate embodiment.

Referring to FIG. 25, where the resisting element (22A) is connected to the resisting element (22B), the resisting element (22A) is provided as described above for the connection of two adjacent resisting element sections (22A) except that the duct (104) is terminated and sealed at the bulkhead plate (106). The resisting element (22B) is provided with a coupling device (26B) for coupling said resisting elements (22A & 22B).

The resisting element (22B) and the coupling device (26B) are covered entirely by the non-communicating sleeve, which may be provided at this location in-situ.

The resisting element (22B) in the un-damped free length portion in the third embodiment is the same as that previously described for the second embodiment At any time after construction of the respective portion of structural element (1) surrounding any embedded duct (104) and resisting element (22A) segments, the thus installed duct (104) segments may be filled, preferably with a cementations or resin based grout (36). The grout (36) is injected into the annular space between the duct (104) and the damping material (28) by way of the grout inlet and outlet sleeves (110 and 112) and grout tubes (114). The grout (36) is injected under pressure, so as to ensure complete filling of the annular space between the duct (104) and the damping material (28). Suitable grouts, as well as the methods and equipment used for grouting, will be well known by those skilled in the art. Such materials, methods and equipment are used regularly in the post-tensioning industry. However, as descried previously, it may be desirable and beneficial to delay grouting some or all segments, until some later time.

When a dynamic force is applied to the structural element (1), such as may result from wind or earthquakes, the second embodiment functions in the same manner as the first and second embodiments, where the resisting element (22A) and the structural element (1) are similarly linked in a shear mode by and through the damping material (28) layer, among other things.

In an alternate embodiment, the apparatus as shown in FIGS. 23-27 and described above may be modified, as shown in FIG. 29, to include a number of resisting elements (22A) grouped to together within a large duct (104). This alternate embodiment is constructed, and functions, in a manner similar to that of the previous embodiments.

Figure 30:
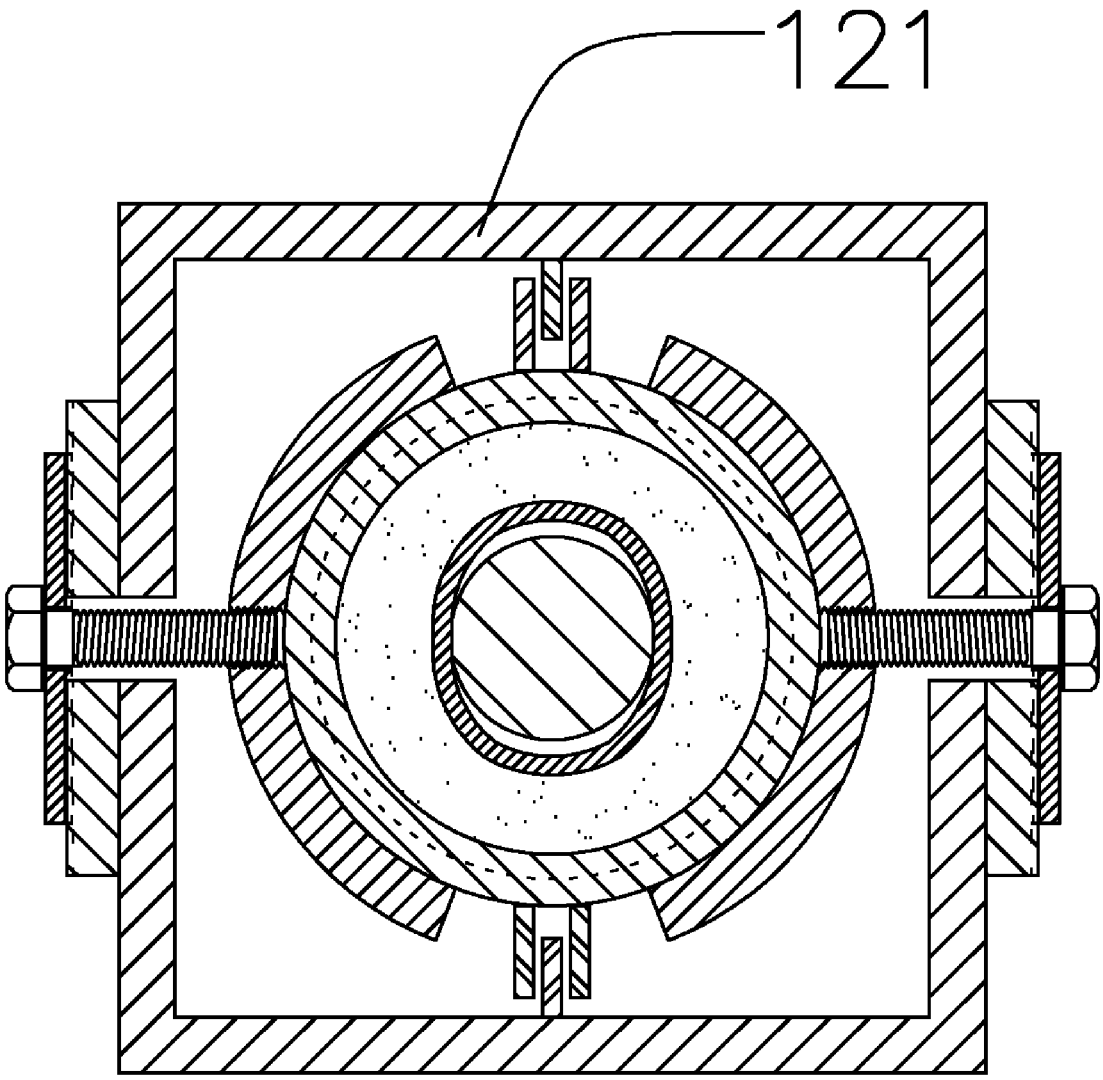
FIG. 30 is a cross-sectional view of yet another alternate embodiment.

The foregoing description of one or more embodiments has been presented for the purposes of illustration and description. While the foregoing detailed description of the embodiments enables one of ordinary skill to make and use the embodiments, those skilled in the art will understand and appreciate the existence of variations, modifications, combinations and equivalents of the specific embodiments and methods presented. It is understood that changes in the specific embodiments and methods shown and described may be made within the scope of the description without departing from the spirit of the invention. For example, in broad embodiment, the apparatus of the first embodiment may easily be adapted for use in steel structures as illustrated in FIG. 30. Referring to FIG. 30, the transfer casing of the first embodiment may be replaced by a continuous structural member (121), such as column, beam or brace, among other things.

Additionally, although all of the drawing figures depict the apparatus of the present embodiments oriented in a vertical position, damping may be achieved with the apparatus installed horizontally, or at any angle. Additionally, although all of the drawing figures depict the fixed-end location at the bottom of the apparatus of the present embodiments, either end of the apparatus may be made to function as the fixed end. Additionally the apparatus of the embodiments may be provided such that damped constrained length resisting element means may be provided at both ends of the resisting element means, with a fixed anchorage to the structural element occurring somewhere between the damped constrained length resisting element segments, and the un-damped free length resisting element segments provided between the fixed anchorage and the damped constrained length resisting element segments.

I claim:

1. A method of increasing the vibrational energy dissipation of structural elements comprising the following steps:

a) constructing a structural element with an internal hollow casing in such a manner that said hollow casing acts as an integral part of said structural element, b) covering at least a portion of a force resisting member with a damping material having vibrational energy dissipation characteristics, c) inserting said force resisting member into said hollow casing and securing one anchorage end of said force resisting member to said structural element in a rigid force-transmitting manner, d) connecting said force resisting member to said hollow casing at any time in a force-transmitting manner through said damping material in an intermediate location between said one end and an opposite end of said force resisting member, and in such a manner that all forces transmitted between said force resisting member and said hollow casing occurs through said damping material, and e) providing access openings in said structural element to said one end of said force resisting member and said intermediate location to allow installation and removal of said force resisting member.

2. The method of claim 1 in which said damping material has viscoelastic properties.

3. An apparatus for increasing the vibrational energy dissipation of structural elements comprising:

a) a hollow casing constructed within a structural element, and in such a manner that said hollow casing acts as an integral part of said structural element, b) a force resisting assembly comprising a force resisting member within said hollow casing with a damping material having vibrational energy dissipation characteristics covering at least a portion of said force resisting member, and a remaining portion of said force resisting member being an un-damped free length portion, c) said force resisting member having an anchorage for securing one end of said force resisting member to said structural element in a force-transmitting manner, d) said force resisting member having a connection assembly between ends thereof for connecting said force resisting member to said hollow casing in a force-transmitting manner at any time through said damping material, and in such a manner that all forces transmitted between said force resisting member and said hollow casing occurs through said damping material; wherein said structure element has access holes in said structural element to one end of said force resisting member and an intermediate location to allow installation and removal of said force resisting assembly at any time.

4. The apparatus of claim 3 in which said damping material has viscoelastic properties.

5. A method of increasing the vibrational energy dissipation of structural elements comprising the following steps:

a) constructing a structural element with an internal hollow casing in such a manner that said hollow casing acts as an integral part of said structural element, b) covering at least a portion of a force resisting member with a damping material having vibrational energy dissipation characteristics, c) inserting said force resisting member into said hollow casing and securing one anchorage end of said force resisting member to said structural element in a rigid force-transmitting manner, d) connecting said force resisting member to said hollow casing at any time in a force-transmitting manner through said damping material only at said portion of said force resisting member, and in such a manner that all forces transmitted between said force resisting member and said hollow casing occurs through said damping material; and e) providing at least one access opening in said structural element to said portion of said force resisting member and an intermediate location to allow said connection of said force resisting member.

6. The method of claim 5 in which said damping material has viscoelastic properties.

* * * * *